US008272583B2

(12) United States Patent
Hunnicutt et al.

(10) Patent No.: US 8,272,583 B2
(45) Date of Patent: Sep. 25, 2012

(54) SPRINKLER WITH VARIABLE ARC AND FLOW RATE AND METHOD

(75) Inventors: Steven B. Hunnicutt, Vail, AZ (US); Samuel C. Walker, Green Valley, AZ (US)

(73) Assignee: Rain Bird Corporation, Azusa, CA (US)

( * ) Notice: Subject to any disclaimer, the term of this patent is extended or adjusted under 35 U.S.C. 154(b) by 296 days.

(21) Appl. No.: 12/475,242

(22) Filed: May 29, 2009

(65) Prior Publication Data

US 2010/0301142 A1 Dec. 2, 2010

(51) Int. Cl.

| | |
|---|---|
| ***B05B 1/30*** | (2006.01) |
| ***B05B 1/32*** | (2006.01) |
| ***B05B 1/26*** | (2006.01) |
| ***B44D 5/10*** | (2006.01) |

(52) U.S. Cl. ..... 239/582.1; 239/224; 239/456; 239/460; 239/507; 239/513; 239/581.2

(58) Field of Classification Search ..... 239/210, 239/222.17, 224, 237, 240, 451, 453, 456, 239/457, 460, 501, 507, 512, 513, 514, 524, 239/581.1, 582.1

See application file for complete search history.

(56) References Cited

U.S. PATENT DOCUMENTS

| | | | |
|---|---|---|---|
| 2,634,163 | A | 4/1953 | Double |
| 2,723,879 | A | 11/1955 | Martin |
| 2,875,783 | A | 3/1959 | Schippers |
| 2,935,266 | A | 5/1960 | Coleondro et al. |
| 3,940,066 | A | 2/1976 | Hunter |
| 3,955,764 | A | 5/1976 | Phaup |
| 4,026,471 | A | 5/1977 | Hunter |
| 4,119,275 | A | 10/1978 | Hunter |
| 4,131,234 | A | 12/1978 | Pescetto |
| 4,189,099 | A | 2/1980 | Bruninga |

(Continued)

FOREIGN PATENT DOCUMENTS

EP 0724913 A2 7/1996

(Continued)

OTHER PUBLICATIONS

U.S. Appl. No. 12/248,644, filed Oct. 9, 2008, entitled "Sprinkler with Variable Arc and Flow Rate".

(Continued)

*Primary Examiner* — Len Tran
*Assistant Examiner* — Ryan Reis
(74) *Attorney, Agent, or Firm* — Fitch, Even, Tabin & Flannery, LLP

(57) ABSTRACT

A variable arc sprinkler head or nozzle may be set to numerous positions to adjust the arcuate span of the sprinkler. The sprinkler head includes an arc adjustment valve having two portions that helically engage each other to define an opening that may be adjusted at the top of the sprinkler to a desired arcuate length. The arcuate length may be adjusted by pressing down and rotating a deflector to directly actuate the valve without the need for a hand tool. A method of irrigation is also provided involving moving the deflector between an arc adjustment position and an operational, irrigation position. The sprinkler head may also include a flow rate adjustment valve that may be adjusted by actuation or rotation of an outer wall portion of the sprinkler. Rotation of the outer wall portion causes a flow control member to move axially to or away from an inlet.

36 Claims, 30 Drawing Sheets

U.S. PATENT DOCUMENTS

| | | | |
|---|---|---|---|
| 4,198,000 | A | 4/1980 | Hunter |
| 4,253,608 | A | 3/1981 | Hunter |
| 4,272,024 | A | 6/1981 | Kah, Jr. |
| 4,353,506 | A | 10/1982 | Hayes |
| 4,353,507 | A | 10/1982 | Kah, Jr. |
| 4,398,666 | A | 8/1983 | Hunter |
| 4,471,908 | A | 9/1984 | Hunter |
| 4,501,391 | A | 2/1985 | Hunter |
| 4,566,632 | A | 1/1986 | Sesser |
| 4,568,024 | A | 2/1986 | Hunter |
| 4,579,285 | A | 4/1986 | Hunter |
| 4,624,412 | A | 11/1986 | Hunter |
| 4,625,917 | A | 12/1986 | Torney |
| RE32,386 | E | 3/1987 | Hunter |
| 4,660,766 | A | 4/1987 | Nelson et al. |
| 4,669,663 | A | 6/1987 | Meyer |
| 4,676,438 | A | 6/1987 | Sesser |
| 4,708,291 | A | 11/1987 | Grundy |
| 4,718,605 | A | 1/1988 | Hunter |
| 4,720,045 | A | 1/1988 | Meyer |
| 4,739,934 | A | 4/1988 | Gewelber |
| D296,464 | S | 6/1988 | Marmol et al. |
| 4,752,031 | A | 6/1988 | Merrick |
| 4,763,838 | A | 8/1988 | Holcomb |
| 4,796,809 | A | 1/1989 | Hunter |
| 4,796,811 | A | 1/1989 | Davisson |
| 4,815,662 | A | 3/1989 | Hunter |
| 4,834,289 | A | 5/1989 | Hunter |
| 4,836,449 | A | 6/1989 | Hunter |
| 4,836,450 | A | 6/1989 | Hunter |
| 4,840,312 | A | 6/1989 | Tyler |
| 4,842,201 | A | 6/1989 | Hunter |
| 4,867,378 | A | 9/1989 | Kah, Jr. |
| 4,898,332 | A | 2/1990 | Hunter et al. |
| 4,901,924 | A | 2/1990 | Kah, Jr. |
| 4,932,590 | A | 6/1990 | Hunter |
| 4,944,456 | A | 7/1990 | Zakai |
| 4,948,052 | A | 8/1990 | Hunter |
| 4,955,542 | A | 9/1990 | Kah, Jr. |
| 4,961,534 | A | 10/1990 | Tyler et al. |
| 4,967,961 | A | 11/1990 | Hunter |
| 4,971,250 | A | 11/1990 | Hunter |
| 4,986,474 | A | 1/1991 | Schisler et al. |
| 5,031,840 | A | 7/1991 | Grundy et al. |
| 5,050,800 | A | 9/1991 | Lamar |
| 5,052,621 | A | 10/1991 | Katzer et al. |
| 5,058,806 | A | 10/1991 | Rupar |
| 5,083,709 | A | 1/1992 | Iwanowski |
| RE33,823 | E | 2/1992 | Nelson et al. |
| 5,086,977 | A | 2/1992 | Kah, Jr. |
| 5,098,021 | A | 3/1992 | Kah, Jr. |
| 5,104,045 | A | 4/1992 | Kah, Jr. |
| 5,123,597 | A | 6/1992 | Bendall |
| 5,141,024 | A | 8/1992 | Hicks |
| 5,148,990 | A | 9/1992 | Kah, Jr. |
| 5,148,991 | A | 9/1992 | Kah, Jr. |
| 5,158,232 | A | 10/1992 | Tyler et al. |
| 5,199,646 | A | 4/1993 | Kah, Jr. |
| 5,205,491 | A | 4/1993 | Hadar |
| 5,224,653 | A | 7/1993 | Nelson et al. |
| 5,226,599 | A | 7/1993 | Lindermeir et al. |
| 5,226,602 | A | 7/1993 | Cochran et al. |
| 5,234,169 | A | 8/1993 | McKenzie |
| 5,240,182 | A | 8/1993 | Lemme |
| 5,240,184 | A | 8/1993 | Lawson |
| 5,267,689 | A | 12/1993 | Forer |
| 5,288,022 | A | 2/1994 | Sesser |
| 5,299,742 | A | 4/1994 | Han |
| 5,322,223 | A | 6/1994 | Hadar |
| 5,360,167 | A | 11/1994 | Grundy et al. |
| 5,370,311 | A | 12/1994 | Chen |
| 5,372,307 | A | 12/1994 | Sesser |
| 5,375,768 | A | 12/1994 | Clark |
| 5,417,370 | A | 5/1995 | Kah, Jr. |
| 5,423,486 | A | 6/1995 | Hunter |
| 5,435,490 | A | 7/1995 | Machut |
| 5,439,174 | A | 8/1995 | Sweet |
| RE35,037 | E | 9/1995 | Kah, Jr. |
| 5,456,411 | A | 10/1995 | Scott et al. |
| 5,526,982 | A | 6/1996 | McKenzie |
| 5,544,814 | A | 8/1996 | Spenser |
| 5,556,036 | A | 9/1996 | Chase |
| 5,588,594 | A | 12/1996 | Kah, Jr. |
| 5,588,595 | A | 12/1996 | Sweet et al. |
| 5,598,977 | A | 2/1997 | Lemme |
| 5,611,488 | A | 3/1997 | Frolich |
| 5,642,861 | A | 7/1997 | Ogi et al. |
| 5,653,390 | A | 8/1997 | Kah, Jr. |
| 5,662,545 | A | 9/1997 | Zimmerman et al. |
| 5,671,885 | A | 9/1997 | Davisson |
| 5,671,886 | A | 9/1997 | Sesser |
| 5,676,315 | A | 10/1997 | Han |
| D388,502 | S | 12/1997 | Kah, III |
| 5,695,123 | A | 12/1997 | Le |
| 5,699,962 | A | 12/1997 | Scott et al. |
| 5,711,486 | A | 1/1998 | Clark et al. |
| 5,718,381 | A | 2/1998 | Katzer et al. |
| 5,720,435 | A | 2/1998 | Hunter |
| 5,722,593 | A | 3/1998 | McKenzie |
| 5,758,827 | A | 6/1998 | Van Le et al. |
| 5,762,270 | A | 6/1998 | Kearby et al. |
| 5,765,757 | A | 6/1998 | Bendall |
| 5,769,322 | A | 6/1998 | Smith |
| 5,785,248 | A | 7/1998 | Staylor et al. |
| 5,823,439 | A | 10/1998 | Hunter et al. |
| 5,823,440 | A | 10/1998 | Clark |
| 5,826,797 | A | 10/1998 | Kah, III |
| 5,845,849 | A | 12/1998 | Mitzlaff |
| 5,875,969 | A | 3/1999 | Grundy |
| 5,918,812 | A | 7/1999 | Beutler |
| 5,927,607 | A | 7/1999 | Scott |
| 5,971,297 | A | 10/1999 | Sesser |
| 5,988,523 | A | 11/1999 | Scott |
| 6,019,295 | A | 2/2000 | McKenzie |
| 6,029,907 | A | 2/2000 | McKenzie |
| 6,042,021 | A | 3/2000 | Clark |
| 6,050,502 | A | 4/2000 | Clark |
| 6,085,995 | A | 7/2000 | Kah, Jr. et al. |
| 6,109,545 | A | 8/2000 | Kah, Jr. |
| 6,138,924 | A | 10/2000 | Hunter et al. |
| 6,145,758 | A | 11/2000 | Ogi et al. |
| 6,158,675 | A | 12/2000 | Ogi |
| 6,182,909 | B1 | 2/2001 | Kah, Jr. et al. |
| 6,227,455 | B1 | 5/2001 | Scott et al. |
| 6,237,862 | B1 | 5/2001 | Kah, III et al. |
| 6,241,158 | B1 | 6/2001 | Clark et al. |
| 6,244,521 | B1 | 6/2001 | Sesser |
| 6,264,117 | B1 | 7/2001 | Roman |
| 6,332,581 | B1 | 12/2001 | Chin et al. |
| 6,336,597 | B1 | 1/2002 | Kah, Jr. |
| 6,367,708 | B1 | 4/2002 | Olson |
| D458,342 | S | 6/2002 | Johnson |
| 6,443,372 | B1 | 9/2002 | Hsu |
| 6,454,186 | B2 | 9/2002 | Haverstraw et al. |
| 6,457,656 | B1 | 10/2002 | Scott |
| 6,464,151 | B1 | 10/2002 | Cordua |
| 6,488,218 | B1 | 12/2002 | Townsend et al. |
| 6,491,235 | B1 | 12/2002 | Scott et al. |
| 6,494,384 | B1 | 12/2002 | Meyer |
| 6,499,672 | B1 * | 12/2002 | Sesser ..... 239/222.11 |
| 6,530,531 | B2 | 3/2003 | Butler |
| 6,601,781 | B2 | 8/2003 | Kah, III et al. |
| 6,607,147 | B2 | 8/2003 | Schneider et al. |
| 6,622,940 | B2 | 9/2003 | Huang |
| 6,637,672 | B2 | 10/2003 | Cordua |
| 6,651,905 | B2 | 11/2003 | Sesser et al. |
| 6,688,539 | B2 | 2/2004 | Vander Griend |
| 6,695,223 | B2 | 2/2004 | Beutler et al. |
| 6,732,952 | B2 | 5/2004 | Kah, Jr. |
| 6,736,332 | B2 | 5/2004 | Sesser et al. |
| 6,769,633 | B1 | 8/2004 | Huang |
| 6,814,304 | B2 * | 11/2004 | Onofrio ..... 239/201 |
| 6,814,305 | B2 | 11/2004 | Townsend |
| 6,817,543 | B2 | 11/2004 | Clark |
| 6,827,291 | B2 | 12/2004 | Townsend |
| 6,834,816 | B2 * | 12/2004 | Kah, Jr. ..... 239/451 |
| 6,840,460 | B2 | 1/2005 | Clark |

| | | | | |
|---|---|---|---|---|
| 6,848,632 | B2 | 2/2005 | Clark | |
| 6,854,664 | B2 | 2/2005 | Smith | |
| 6,869,026 | B2 | 3/2005 | McKenzie et al. | |
| 6,871,795 | B2 | 3/2005 | Anuskiewicz | |
| 6,883,727 | B2 * | 4/2005 | De Los Santos | 239/240 |
| 6,921,030 | B2 | 7/2005 | Renquist | |
| 6,945,471 | B2 | 9/2005 | McKenzie et al. | |
| 6,957,782 | B2 | 10/2005 | Clark et al. | |
| 7,017,831 | B2 | 3/2006 | Santiago et al. | |
| 7,028,920 | B2 | 4/2006 | Hekman et al. | |
| 7,028,927 | B2 | 4/2006 | Mermet | |
| 7,032,836 | B2 | 4/2006 | Sesser et al. | |
| 7,032,844 | B2 | 4/2006 | Cordua | |
| 7,040,553 | B2 | 5/2006 | Clark | |
| 7,044,403 | B2 | 5/2006 | Kah, III et al. | |
| 7,090,146 | B1 | 8/2006 | Ericksen et al. | |
| 7,100,842 | B2 | 9/2006 | Meyer et al. | |
| 7,104,472 | B2 | 9/2006 | Renquist | |
| 7,143,957 | B2 | 12/2006 | Nelson | |
| 7,143,962 | B2 | 12/2006 | Kah, Jr. | |
| 7,152,814 | B1 | 12/2006 | Schapper et al. | |
| 7,156,322 | B1 | 1/2007 | Heitzman | |
| 7,159,795 | B2 | 1/2007 | Sesser et al. | |
| 7,168,634 | B2 * | 1/2007 | Onofrio | 239/222.17 |
| 7,232,081 | B2 | 6/2007 | Kah, Jr. et al. | |
| 7,234,651 | B2 | 6/2007 | Mousavi et al. | |
| 7,240,860 | B2 | 7/2007 | Griend | |
| 7,287,711 | B2 | 10/2007 | Crooks | |
| 7,303,147 | B1 | 12/2007 | Danner et al. | |
| RE40,440 | E | 7/2008 | Sesser | |
| 7,607,588 | B2 | 10/2009 | Nobili | |
| 7,611,077 | B2 | 11/2009 | Sesser et al. | |
| 7,621,467 | B1 | 11/2009 | Garcia | |
| 8,074,897 | B2 | 12/2011 | Hunnicutt et al. | |
| 2001/0023901 | A1 | 9/2001 | Haverstraw et al. | |
| 2002/0130202 | A1 | 9/2002 | Kah, Jr. et al. | |
| 2002/0153434 | A1 | 10/2002 | Cordua | |
| 2003/0015606 | A1 | 1/2003 | Cordua | |
| 2003/0075620 | A1 | 4/2003 | Kah, Jr. | |
| 2005/0006501 | A1 | 1/2005 | Englefield | |
| 2007/0181711 | A1 | 8/2007 | Sesser et al. | |
| 2007/0235565 | A1 * | 10/2007 | Kah et al. | 239/514 |
| 2008/0169363 | A1 | 7/2008 | Walker | |
| 2008/0257982 | A1 | 10/2008 | Kah et al. | |
| 2009/0014559 | A1 | 1/2009 | Marino | |
| 2009/0072048 | A1 | 3/2009 | Renquist et al. | |
| 2009/0140076 | A1 * | 6/2009 | Cordua | 239/457 |
| 2009/0173803 | A1 | 7/2009 | Kah, Jr. et al. | |
| 2010/0090024 | A1 | 4/2010 | Hunnicutt | |
| 2010/0301135 | A1 | 12/2010 | Hunnicutt | |

FOREIGN PATENT DOCUMENTS

| | | | |
|---|---|---|---|
| EP | 0761312 | A1 | 12/1997 |
| EP | 1043075 | A1 | 11/2000 |
| EP | 2255884 | A1 | 12/2010 |
| WO | WO9735668 | | 10/1997 |
| WO | WO2005099905 | | 10/2005 |

OTHER PUBLICATIONS

Sep. 30, 2010 Office Action, U.S. Appl. No. 12/248,644.

Jan. 5, 2011 Office Action, U.S. Appl. No. 12/248,644.

U.S. Appl. No. 12/720,261, filed Mar. 9, 2010, entitled "Sprinkler with Variable Arc and Flow Rate and Method," which is a continuation-in-part application of U.S. Appl. No. 12/475,242.

U.S. Appl. No. 12/952,369, filed Nov. 23, 2010, entitled "Sprinkler with Variable Arc and flow Rate and Method," which is a continuation-in-part of U.S. Appl. No. 12/720,261.

Aug. 5, 2010 EPO Search Report and Opinion, EPO Application No. 10164085.2.

Office Action mailed Aug. 24, 2010 in U.S. Appl. No. 11/947,571.

Response to Aug. 24, 2010 Office Action filed on Nov. 24, 2010 in U.S. Appl. No. 11/947,571.

Office Action mailed Apr. 5, 2011 in U.S. Appl. No. 11/947,571.

Response to Apr. 5, 2011 Office Action Filed on Jul. 5, 2011 in U.S. Appl. No. 11/947,571.

Advisory Action mailed Jul. 14, 2011 in U.S. Appl. No. 11/947,571.

U.S. Appl. No. 13/300,946, filed Nov. 21, 2011, entitled "Sprinkler with Variable Arc and Flow Rate and Method," which is a continuation of U.S. Appl. No. 12/248,644.

Jun. 7, 2012 Office Action, U.S. Appl. No. 13/300,946.

Jun. 25, 2012 Response to Office Action, U.S. Appl. No. 13/300,946.

* cited by examiner

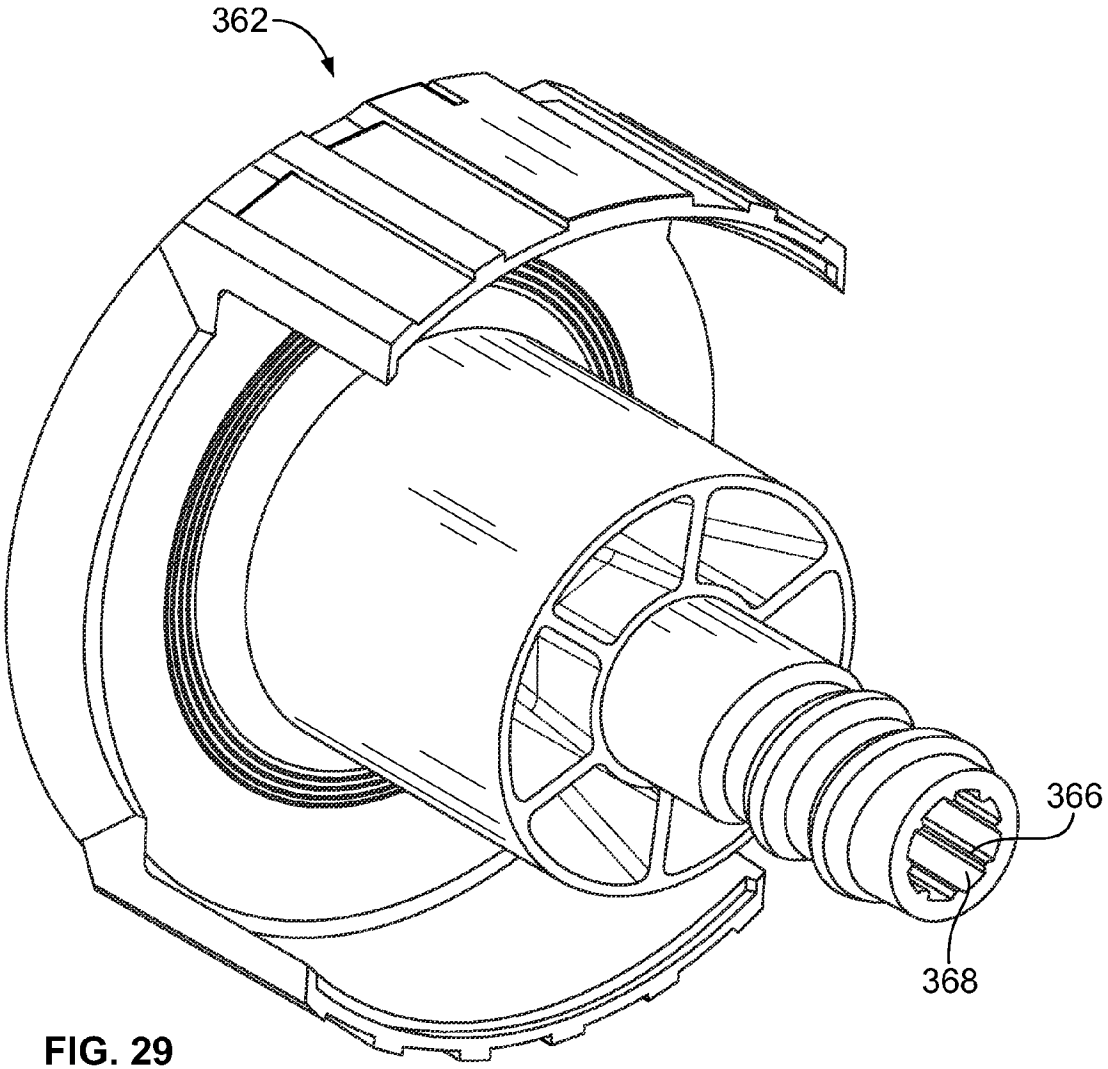
FIG. 29
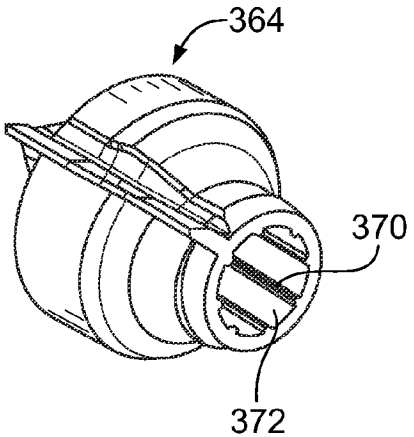

SPRINKLER WITH VARIABLE ARC AND FLOW RATE AND METHOD

FIELD

This invention relates to irrigation sprinklers and, more particularly, to an irrigation sprinkler head and method for distribution of water through an adjustable arc and with an adjustable flow rate.

BACKGROUND

Sprinklers are commonly used for the irrigation of landscape and vegetation. In a typical irrigation system, various types of sprinklers are used to distribute water over a desired area, including rotating stream type and fixed spray pattern type sprinklers. One type of irrigation sprinkler is the rotating deflector or so-called micro-stream type having a rotatable vaned deflector for producing a plurality of relatively small water streams swept over a surrounding terrain area to irrigate adjacent vegetation.

Rotating stream sprinklers of the type having a rotatable vaned deflector for producing a plurality of relatively small outwardly projected water streams are known in the art. In such sprinklers, one or more jets of water are generally directed upwardly against a rotatable deflector having a vaned lower surface defining an array of relatively small flow channels extending upwardly and turning radially outwardly with a spiral component of direction. The water jet or jets impinge upon this underside surface of the deflector to fill these curved channels and to rotatably drive the deflector. At the same time, the water is guided by the curved channels for projection outwardly from the sprinkler in the form of a plurality of relatively small water streams to irrigate a surrounding area. As the deflector is rotatably driven by the impinging water, the water streams are swept over the surrounding terrain area, with the range of throw depending on the flow rate of water through the sprinkler, among other things.

In rotating stream sprinklers and in other sprinklers, it is desirable to control the arcuate area through which the sprinkler distributes water. In this regard, it is desirable to use a sprinkler head that distributes water through a variable pattern, such as a full circle, half-circle, or some other arc portion of a circle, at the discretion of the user. Traditional variable arc sprinkler heads suffer from limitations with respect to setting the water distribution arc. Some have used interchangeable pattern inserts to select from a limited number of water distribution arcs, such as quarter-circle or half-circle. Others have used punch-outs to select a fixed water distribution arc, but once a distribution arc was set by removing some of the punch-outs, the arc could not later be reduced. Many conventional sprinkler heads have a fixed, dedicated construction that permits only a discrete number of arc patterns and prevents them from being adjusted to any arc pattern desired by the user.

Other conventional sprinkler types allow a variable arc of coverage but only for a limited arcuate range. Because of the limited adjustability of the water distribution arc, use of such conventional sprinklers may result in overwatering or underwatering of surrounding terrain. This is especially true where multiple sprinklers are used in a predetermined pattern to provide irrigation coverage over extended terrain. In such instances, given the limited flexibility in the types of water distribution arcs available, the use of multiple conventional sprinklers often results in an overlap in the water distribution arcs or in insufficient coverage. Thus, certain portions of the terrain are overwatered, while other portions are not watered at all. Accordingly, there is a need for a variable arc sprinkler head that allows a user to set the water distribution arc along a substantial continuum of arcuate coverage, rather than several models that provide a limited arcuate range of coverage.

It is also desirable to control or regulate the throw radius of the water distributed to the surrounding terrain. In this regard, in the absence of a flow rate adjustment device, the irrigation sprinkler will have limited variability in the throw radius of water distributed from the sprinkler, given relatively constant water pressure from a source. The inability to adjust the throw radius results both in the wasteful watering of terrain that does not require irrigation or insufficient watering of terrain that does require irrigation. A flow rate adjustment device is desired to allow flexibility in water distribution and to allow control over the distance water is distributed from the sprinkler, without varying the water pressure from the source. Some designs provide only limited adjustability and, therefore, allow only a limited range over which water may be distributed by the sprinkler.

In addition, in previous designs, adjustment of the distribution arc has been regulated through the use of a hand tool, such as a screwdriver. The hand tool may be used to access a slot in the top of the sprinkler cap, which is rotated to increase or decrease the length of the distribution arc. The slot is generally at one end of a shaft that rotates and causes an arc adjustment valve to open or close a desired amount. Users, however, may not have a hand tool readily available when they desire to make such adjustments. It would be therefore desirable to allow arc adjustment from the top of the sprinkler without the need of a hand tool. It would also be desirable to allow the user to depress and rotate the top of the sprinkler to directly actuate the arc adjustment valve, rather than through an intermediate rotating shaft.

Accordingly, a need exists for a truly variable arc sprinkler that can be adjusted to a substantial range of water distribution arcs. In addition, a need exists to increase the adjustability of flow rate and throw radius of an irrigation sprinkler without varying the water pressure, particularly for rotating stream sprinkler heads of the type for sweeping a plurality of relatively small water streams over a surrounding terrain area. Further, a need exists for a sprinkler head that allows a user to directly actuate an arc adjustment valve, rather than through a rotating shaft requiring a hand tool, and to adjust the throw radius by actuating or rotating an outer wall portion of the sprinkler head. Moreover, there is a need for improved concentricity of the arc adjustment valve, uniformity of water flowing through the valve, and a lower cost of assembly. Also, because sprinklers may become clogged with grit or other debris, there is a need for a variable arc sprinkler that allows for convenient flushing of debris from the sprinkler.

BRIEF DESCRIPTION OF THE DRAWINGS

FIG. 29 is a bottom perspective view of the alternative valve sleeve and alternative nozzle cover of FIG. 28;

DESCRIPTION OF THE PREFERRED EMBODIMENTS

Figure 1:
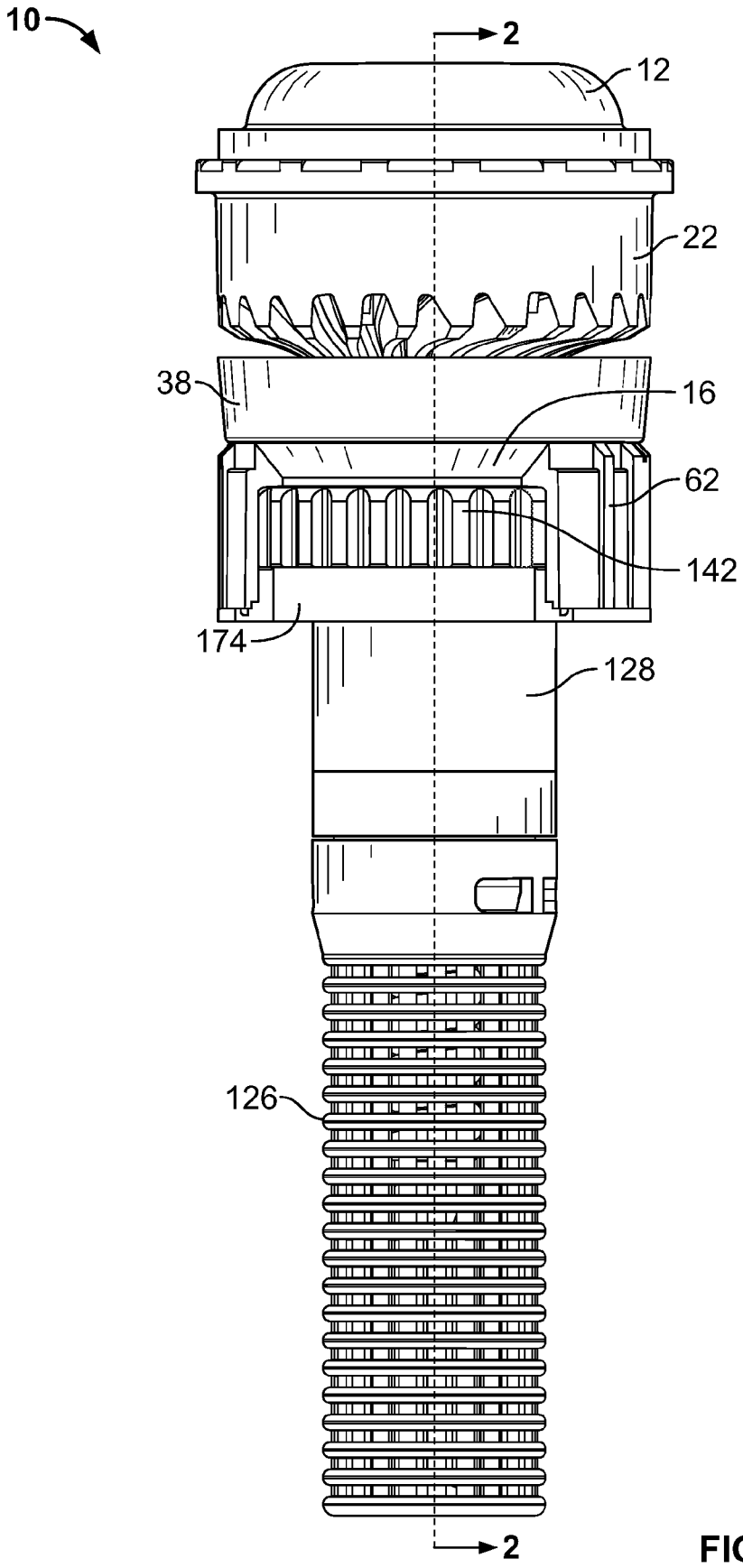
FIG. 1 is a perspective view of a first embodiment of a sprinkler head embodying features of the present invention.

FIGS. 1-4 show a first preferred embodiment of the sprinkler head or nozzle 10. The sprinkler head 10 possesses an arc adjustability capability that allows a user to generally set the arc of water distribution to virtually any desired angle. The arc adjustment feature does not require a hand tool to access a slot at the top of the sprinkler head 10 to rotate a shaft. Instead, the user may depress part or all of the cap 12 and rotate the cap 12 to directly set an arc adjustment valve 14. The sprinkler head 10 also preferably includes a flow rate adjustment feature, which is shown in FIGS. 1-4, to regulate flow rate. The flow rate adjustment feature is accessible by rotating an outer wall portion of the sprinkler head 10, as described further below.

As described in more detail below, the sprinkler head 10 allows a user to depress and rotate a cap 12 to directly actuate the arc adjustment valve 14, i.e., to open and close the valve. The user depresses the cap 12 to directly engage and rotate one of the two nozzle body portions that forms the valve 14 (valve sleeve 64). The valve 14 preferably operates through the use of two helical engagement surfaces that cam against one another to define an arcuate slot 20. Although the sprinkler head 10 preferably includes a shaft 34, the user does not need to use a hand tool to effect rotation of the shaft 34 to open and close the arc adjustment valve 14. The shaft 34 is not rotated to cause opening and closing of the valve 14. Indeed, in certain forms, the shaft 34 may be fixed against rotation, such as through use of splined engagement surfaces.

The sprinkler head 10 also preferably uses a spring 186 mounted to the shaft 34 to energize and tighten the seal of the closed portion of the arc adjustment valve 14. More specifically, the spring 186 operates on the shaft 34 to bias the first of the two nozzle body portions that forms the valve 14 (valve sleeve 64) downwardly against the second portion (nozzle cover 62). In one preferred form, the shaft 34 translates up and down a total distance corresponding to one helical pitch. The vertical position of the shaft 34 depends on the orientation of the two helical engagement surfaces with respect to one another. By using a spring 186 to maintain a forced engagement between valve sleeve 64 and nozzle cover 62, the sprinkler head 10 provides a tight seal of the closed portion of the arc adjustment valve 14, concentricity of the valve 20, and a uniform jet of water directed through the valve 14. In addition, mounting the spring 186 at one end of the shaft 34 results in a lower cost of assembly. Further, as described below, the spring 186 also provides a tight seal of other portions of the nozzle body 16, i.e., the nozzle cover 62 and collar 128.

As can be seen in FIGS. 1-4, the sprinkler head 10 generally comprises a compact unit, preferably made primarily of lightweight molded plastic, which is adapted for convenient thread-on mounting onto the upper end of a stationary or pop-up riser (not shown). In operation, water under pressure is delivered through the riser to a nozzle body 16. The water preferably passes through an inlet 134 controlled by an adjustable flow rate feature that regulates the amount of fluid flow through the nozzle body 16. The water is then directed through an arcuate slot 20 that is generally adjustable between about 0 and 360 degrees and controls the arcuate span of water distributed from the sprinkler head 10. Water is directed generally upwardly through the arcuate slot 20 to produce one or more upwardly directed water jets that impinge the underside surface of a deflector 22 for rotatably driving the deflector 22. Although the arcuate slot 20 is generally adjustable through an entire 360 degree arcuate range, water flowing through the slot 20 may not be adequate to impart sufficient force for desired rotation of the deflector 22, when the slot 20 is set at relatively low angles.

Figure 4:
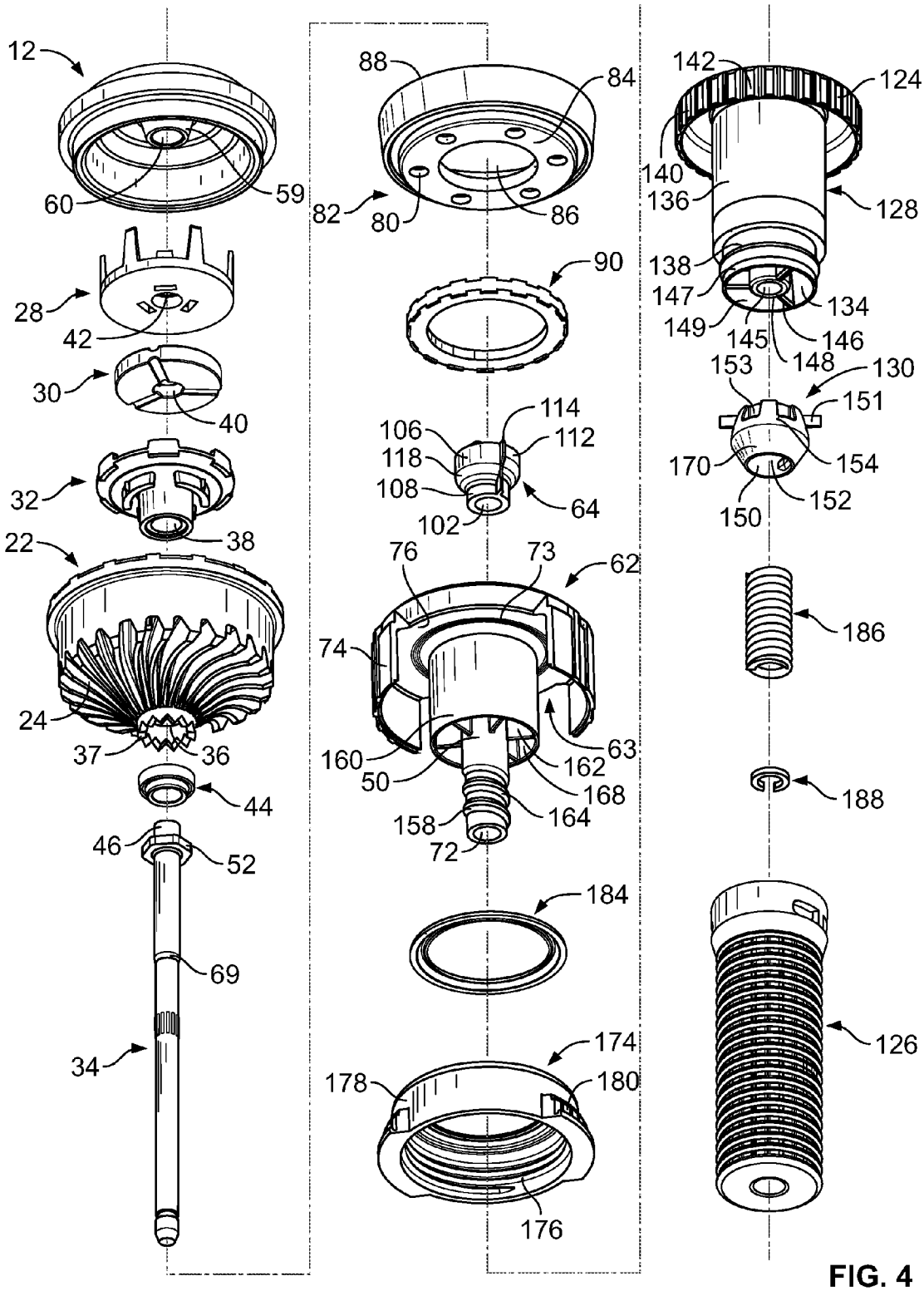
FIG. 4 is a bottom exploded perspective view of the sprinkler head of FIG. 1.

The rotatable deflector 22 has an underside surface that is contoured to deliver a plurality of fluid streams generally radially outwardly therefrom through an arcuate span. As shown in FIG. 4, the underside surface of the deflector 22 preferably includes an array of spiral vanes 24. The spiral vanes 24 subdivide the water jet or jets into the plurality of relatively small water streams which are distributed radially outwardly therefrom to surrounding terrain as the deflector 22 rotates. The vanes 24 define a plurality of intervening flow channels extending upwardly and spiraling along the underside surface to extend generally radially outwardly with selected inclination angles. During operation of the sprinkler head 10, the upwardly directed water jet or jets impinge upon the lower or upstream segments of these vanes 24, which subdivide the water flow into the plurality of relatively small flow streams for passage through the flow channels and radially outward projection from the sprinkler head 10. A deflector like the type shown in U.S. Pat. No. 6,814,304, which is assigned to the assignee of the present application and is incorporated herein by reference in its entirety, is preferably used. Other types of deflectors, however, may also be used The deflector 22 has a bore 36 for insertion of a shaft 34 therethrough. As can be seen in FIG. 4, the bore 36 is defined at its lower end by circumferentially-arranged, downwardly-protruding teeth 37. As described further below, these teeth 37 are sized to engage corresponding teeth 66 in valve sleeve 64. This engagement allows a user to depress the cap 12 and thereby directly engage and drive the valve sleeve 64 for opening and close the valve 20 (without the need for a rotating shaft). Also, the deflector 22 may optionally include a screwdriver slot and/or a coin slot in its top surface (not shown) to allow other methods for adjusting the valve 20 (without the need for rotating the shaft). Optionally, the deflector 22 may also include a knurled external surface along its top circumference to provide for better gripping by a user making an arc adjustment.

The deflector 22 also preferably includes a speed control brake to control the rotational speed of the deflector 22, as more fully described in U.S. Pat. No. 6,814,304. In the preferred form shown in FIGS. 3-5, the speed control brake includes a brake disk 28, a brake pad 30, and a friction plate 32. The friction plate 32 is rotatable with the deflector 22 and, during operation of the sprinkler head 10, is urged against the brake pad 30, which, in turn, is retained against the brake disk 28. Water is directed upwardly and strikes the deflector 22, pushing the deflector 22 and friction plate 32 upwards and causing rotation. In turn, the rotating friction plate 32 engages the brake pad 30, resulting in frictional resistance that serves to reduce, or brake, the rotational speed of the deflector 22. Although the speed control brake is shown and preferably used in connection with sprinkler head 10 described and claimed herein, other brakes or speed reducing mechanisms are available and may be used to control the rotational speed of the deflector 22.

The deflector 22 is supported for rotation by shaft 34. Shaft 34 lies along and defines a central axis C-C of the sprinkler head 10, and the deflector 22 is rotatably mounted on an upper end of the shaft 34. As can be seen from FIGS. 3-4, the shaft 34 extends through a bore 36 in the deflector 22 and through bores 38, 40, and 42 in the friction plate 32, brake pad 30, and brake disk 28, respectively. The sprinkler head 10 also preferably includes a seal member 44, such as an o-ring or lip seal, about the shaft 34 at the deflector bore 36 to prevent the ingress of upwardly-directed fluid into the interior of the deflector 22.

A cap 12 is mounted to the top of the deflector 22. The cap 12 prevents grit and other debris from coming into contact with the components in the interior of the deflector 22, such as the speed control brake components, and thereby hindering the operation of the sprinkler head 10. The cap 12 preferably includes a cylindrical interface 59 protruding from its underside and defining a cylindrical recess 60 for insertion of the upper end 46 of the shaft 34. The recess 60 provides space for the shaft upper end 46 during an arc adjustment, i.e., when the user pushes down and rotates the cap 12 to the desired arcuate span, as described further below.

Figure 3:
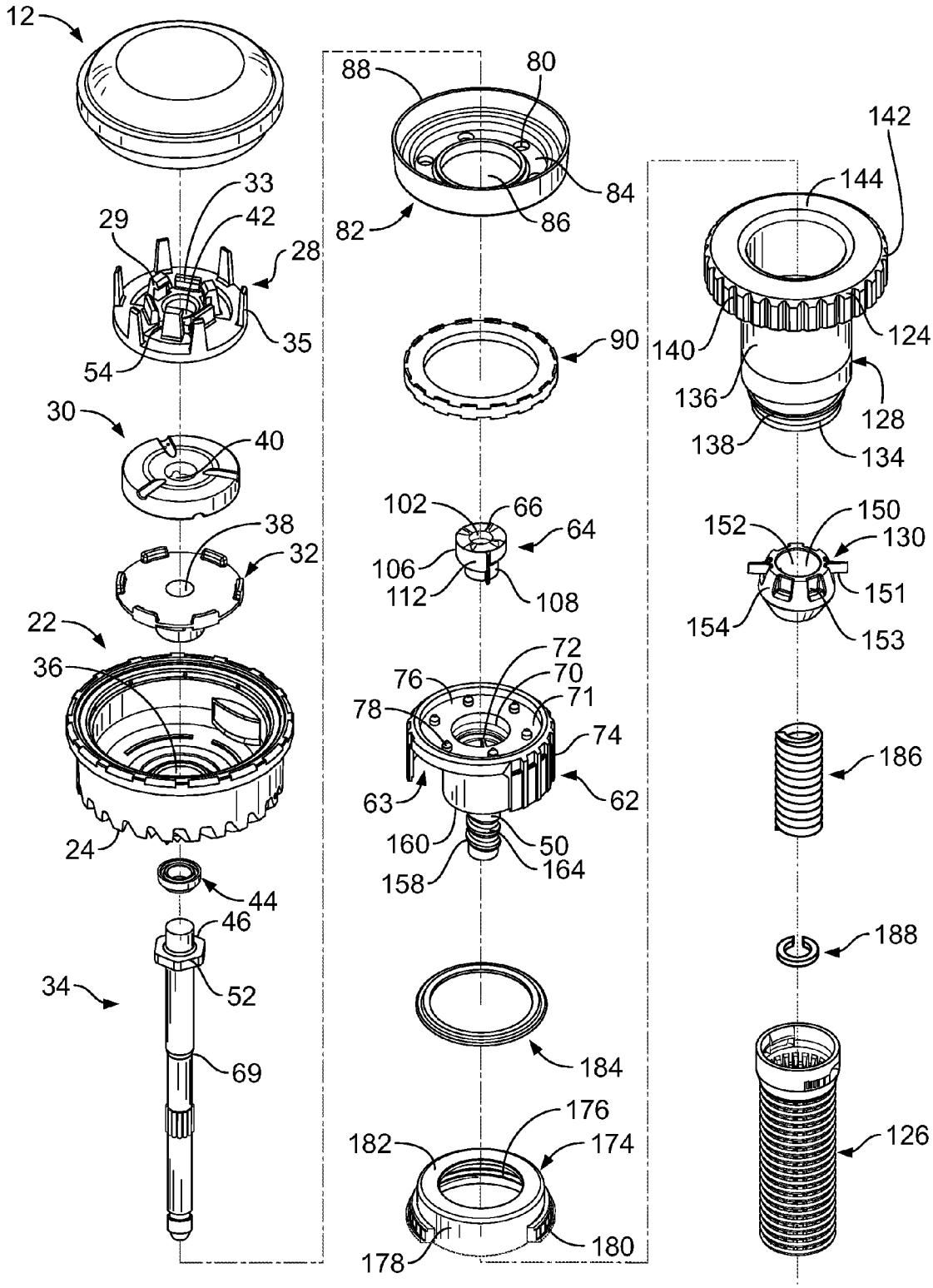
FIG. 3 is a top exploded perspective view of the sprinkler head of FIG. 1.
Figure 5:
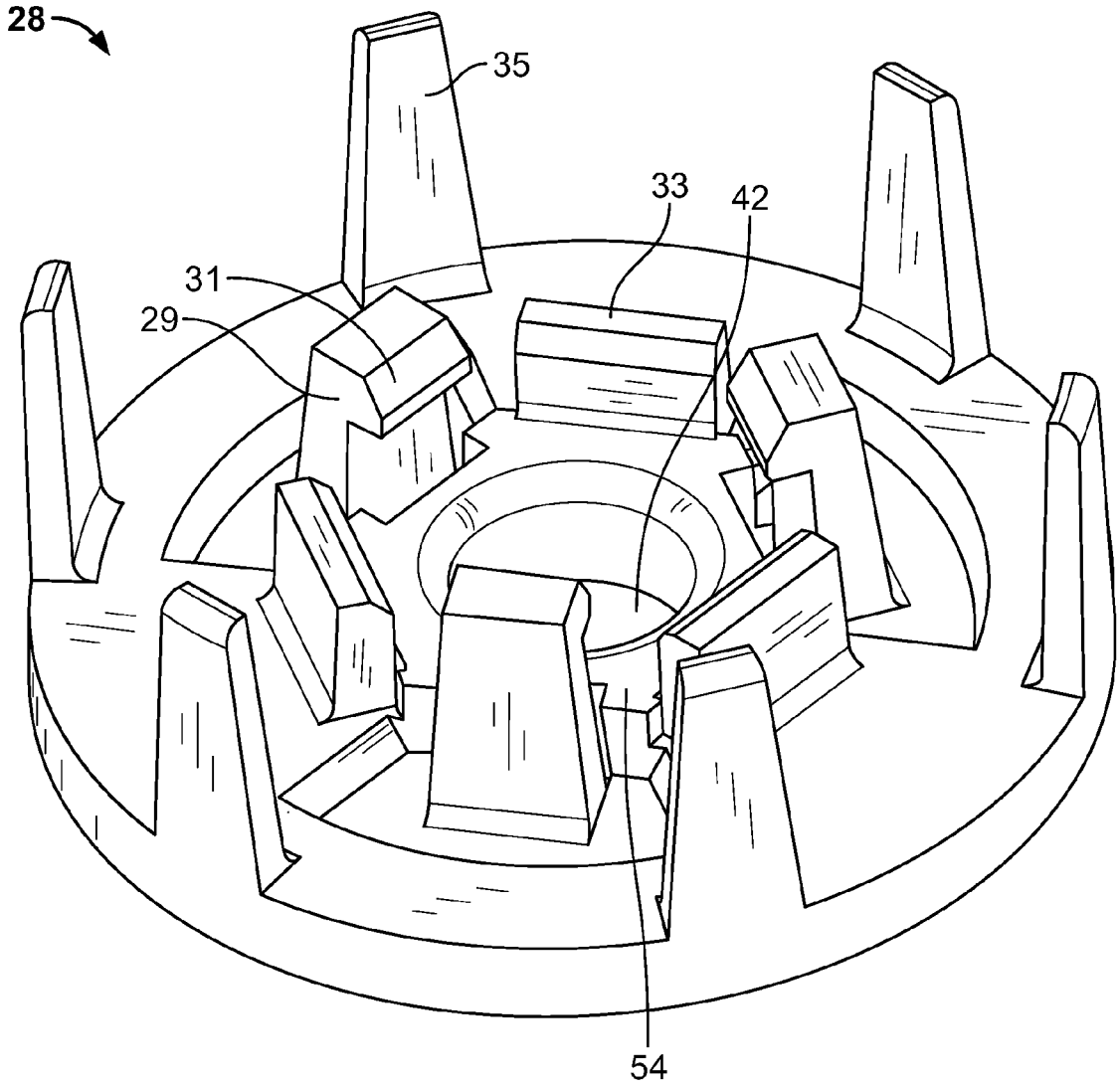
FIG. 5 is a perspective view of a brake disk of the sprinkler head of FIG. 1.

As shown in FIGS. 3-4, the shaft 34 also preferably includes a lock flange 52 for engagement with a lock seat 54 of the brake disk 28 (FIG. 5) when the shaft 34 is mounted. The flange 52 is preferably hexagonal in shape for engagement with a correspondingly hexagonally shaped lock seat 54, although other shapes may be used. The engagement of the flange 52 within the lock seat 54 prevents rotation of the brake disk 28 during operation of the sprinkler head 10. The brake disk 28 further preferably includes barbs 29 with hooked flanges 31 that are spaced about the hexagonal lock seat 54. These barbs 29 help retain the brake disk 28 to the shaft 34 during push down arc adjustment of the sprinkler head 10. As shown in FIG. 5, in one preferred form, three barbs 29 alternate with three posts 33 about the hexagonal lock seat 54. The brake disk 28 also preferably includes elastic members 35 that return the cap 12 and deflector 22 to their normal elevated position following an arc adjustment by the user, as described further below.

The sprinkler head 10 preferably provides feedback to indicate to a user that a manual arc adjustment has been completed. It provides this feedback both when the user is performing an arc adjustment while the sprinkler head 10 is irrigating, i.e., a "wet adjust," and when the user is performing an arc adjustment while the sprinkler head 10 is not irrigating, i.e., a "dry adjust." During a "wet adjust," the user pushes the cap 12 down to an arc adjustment position. In this position, the deflector teeth 37 directly engage the corresponding teeth 66 in the valve sleeve 64, and the user rotates to the desired arcuate setting and releases the cap 12. Following release, water directed upwardly against the deflector 22 causes the deflector 22 to return to its normal elevated, disengaged, and operational position. This return to the operational position from the adjustment position provides feedback to the user that the arc adjustment has been completed.

During a "dry adjust," however, water does not return the deflector 22 to the normal elevated position because water is not flowing through the sprinkler head 10 at all. In this circumstance, the elastic members 35 of the brake disk 28 return the deflector 22 to the elevated position. The elastic members 35 are operatively coupled to the shaft 34 and are sized and positioned to provide a spring force that biases the cap 12 away from the brake disk 28. When the user depresses the cap 12 for arc adjustment, the user causes the elastic members 35 to become compressed. Following push down, rotation, and release of the cap 12, the elastic members 35 exert an upward force against the underside of the cap 12 to return the cap 12 and deflector 22 to their normal elevated position. As shown in FIG. 5, in one preferred form, there are six elastic members 35 spaced equidistantly about the outer circumference of the brake disk 28. Other types and arrangements of elastic members may also be used. For example, the elastic members 35 may be replaced with one or more coil springs that provide the requisite biasing force.

The variable arc capability of sprinkler head 10 results from the interaction of two portions of the nozzle body 16 (nozzle cover 62 and valve sleeve 64). More specifically, as shown in FIGS. 2, 6, 7, and 12, the nozzle cover 62 and the valve sleeve 64 have corresponding helical engagement surfaces. The valve sleeve 64 may be rotatably adjusted with respect to the nozzle cover 62 to close the arc adjustment valve 14, i.e., to adjust the length of arcuate slot 20, and this rotatable adjustment also results in upward or downward translation of the valve sleeve 64. In turn, this camming action results in upward or downward translation of the shaft 34 with the valve sleeve 64. The arcuate slot 20 may be adjusted to any desired water distribution arc by the user through push down and rotation of the cap 12.

Figure 6:
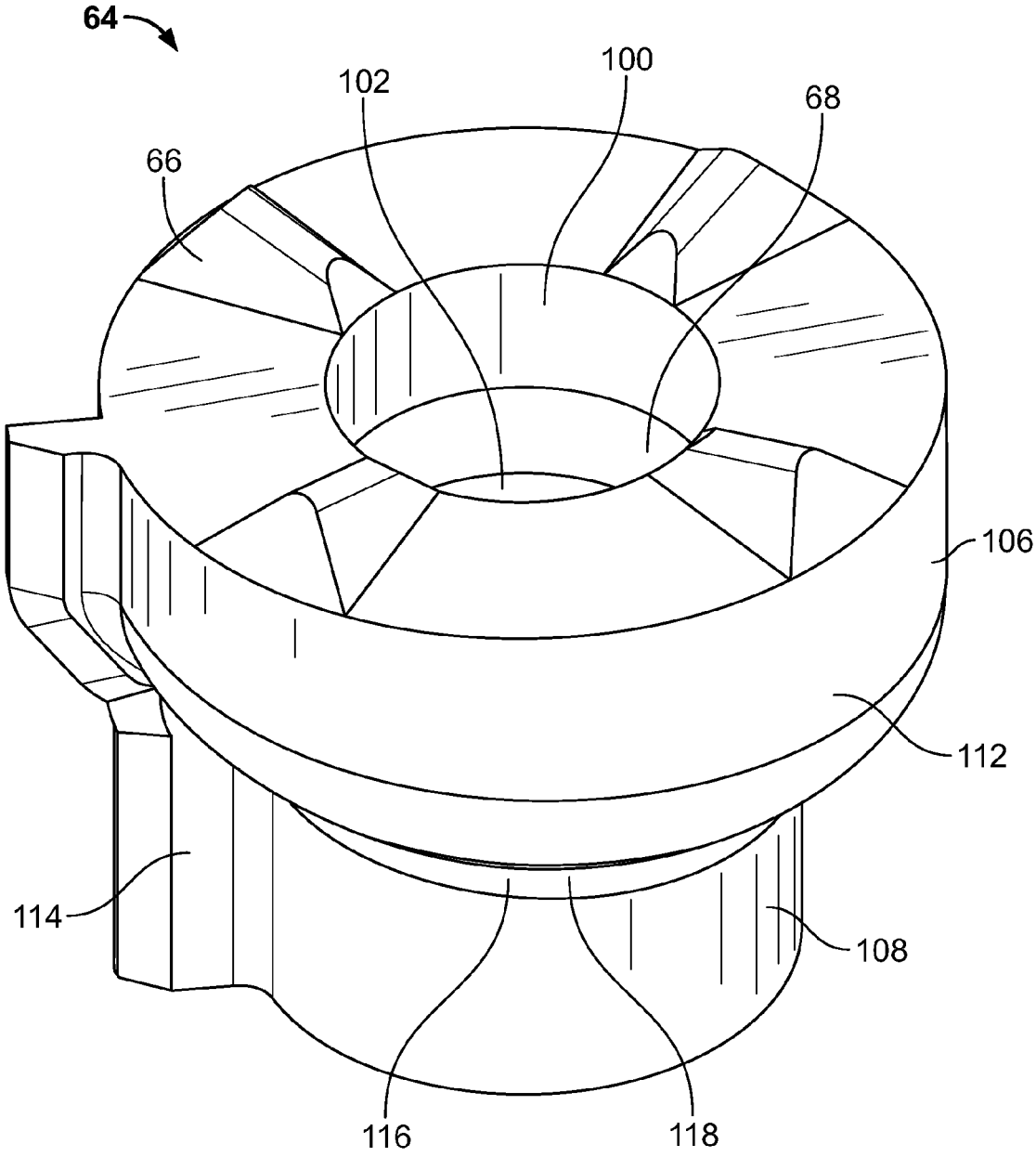
FIG. 6 is a perspective view of the valve sleeve of the sprinkler head of FIG. 1.
Figure 7:
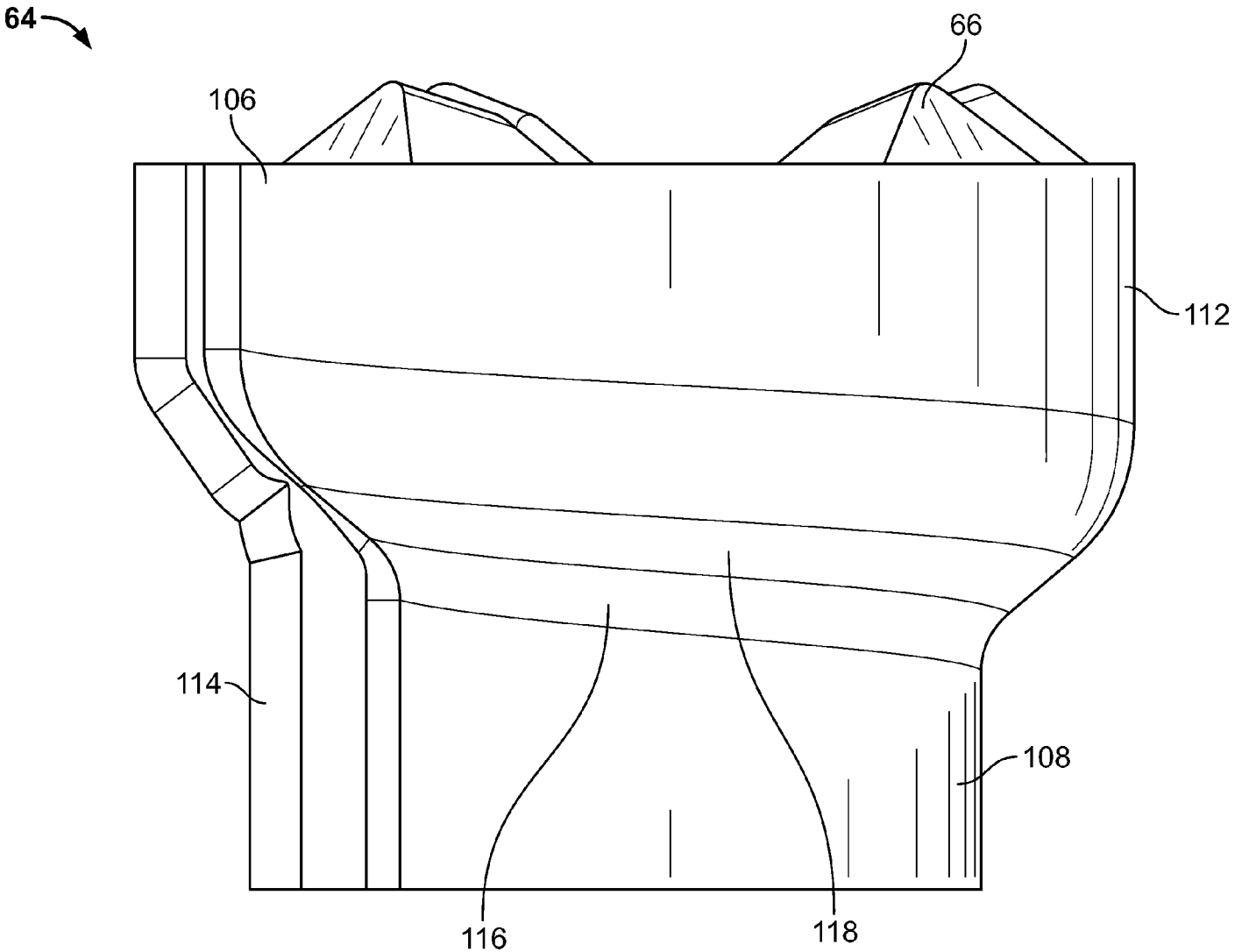
FIG. 7 is a side elevational view of the valve sleeve of the sprinkler head of FIG. 1.
Figure 8:
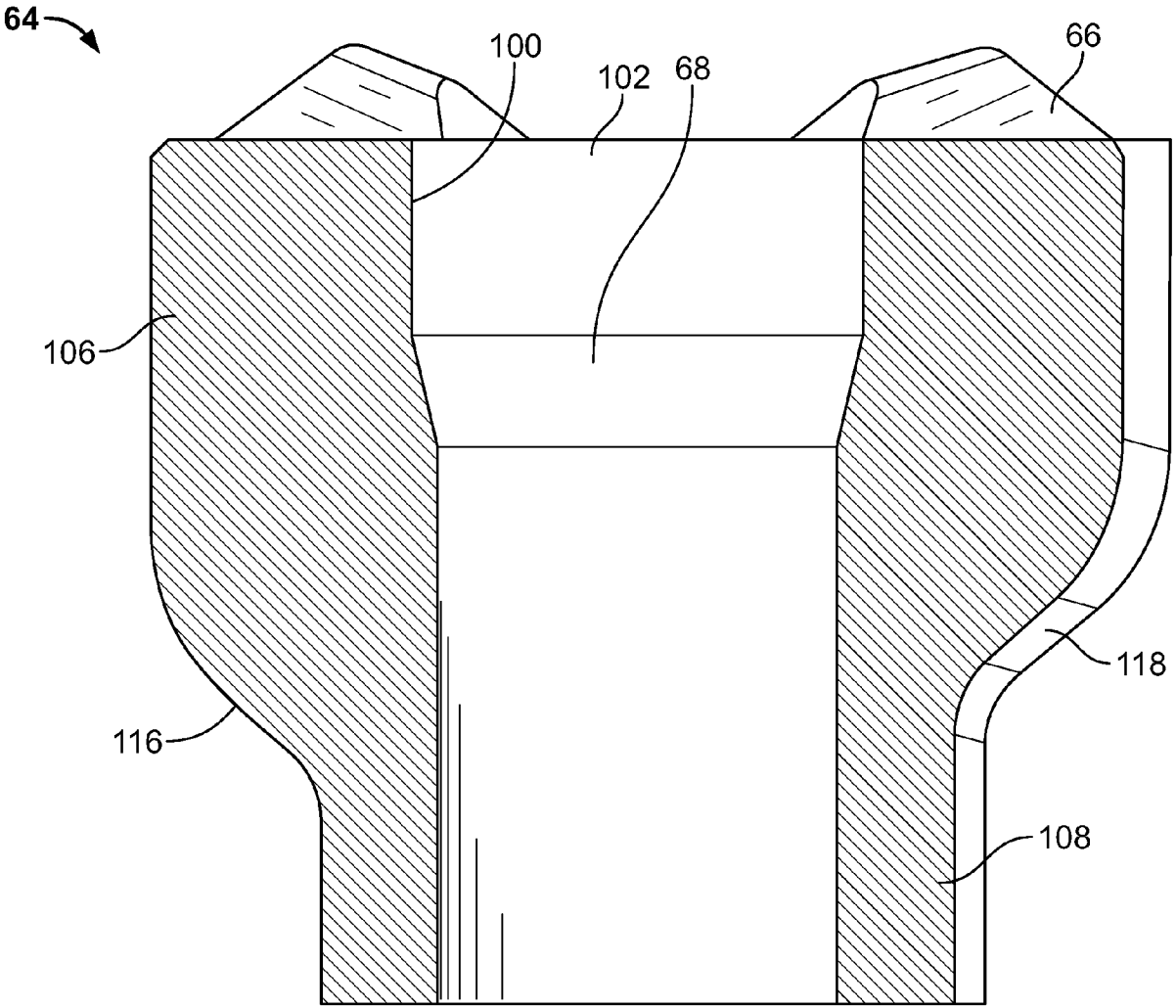
FIG. 8 is a cross-sectional view of the valve sleeve of the sprinkler head of FIG. 1.

As shown in FIGS. 6-8, the valve sleeve 64 has a generally cylindrical shape. The valve sleeve 64 includes a central hub 100 defining a bore 102 therethrough for insertion of the shaft 34. The downward biasing force of spring 186 against shaft 34 results in a friction press fit between an inclined shoulder 69 of the shaft 34 and an inclined inner wall 68 of the valve sleeve 64. The valve sleeve 64 preferably includes an upper cylindrical portion 106 and a lower cylindrical portion 108 having a smaller diameter than the upper portion 106. The upper portion 106 preferably has a top surface with teeth 66 formed therein for engagement with the deflector teeth 37. The valve sleeve 64 also includes an external helical surface 118 that engages and cams against a corresponding helical surface of the nozzle cover 62 to form the arc adjustment valve 14.

The valve sleeve 64 preferably includes additional structure to improve fluid flow through the arc adjustment valve 20. For example, a fin 114 projects radially outwardly and extends axially along the outside of the valve sleeve 64, i.e., along the outer wall 112 of the upper portion 106 and lower portion 108. In addition, the lower portion 108 extends upwardly into a gently curved, radiused segment 116 to allow upwardly directed fluid to be redirected slightly toward the nozzle cover 62 with a relatively insignificant loss in energy and velocity, as described further below.

As shown in FIGS. 9-12, the nozzle cover 62 includes a top generally cylindrical portion 71 and a bottom hub portion 50. The top portion 71 engages the valve sleeve 64 to form the arc adjustment valve 14, and the bottom portion 50 engages a flow control member 130 for flow rate adjustment. Previous designs used multiple separate nozzle pieces to perform some of the functions of these portions. The use of a single nozzle cover 62 has been found to simplify the assembly process. It should be evident that the nozzle portions described herein may be separated into multiple bodies or combined into one or more integral bodies. For example, the sprinkler head 10 may include a lower valve piece (having a second helical engagement surface) entirely separate from the nozzle cover and with a spring mounted between the lower valve piece and the nozzle cover (instead of at the lower end of shaft 34).

The nozzle cover top portion 71 preferably includes a central hub 70 that defines a bore 72 for insertion of the valve sleeve 64 and includes an outer wall 74 having an external knurled surface for easy and convenient gripping and rotating of the sprinkler head 10 to assist in mounting onto the threaded end of a riser. The top portion 71 also preferably includes an annular top surface 76 with circumferential equidistantly spaced bosses 78 extending upwardly from the top surface 76. The bosses 78 engage corresponding circumferential equidistantly spaced apertures 80 in a rubber collar 82 mounted on top of the nozzle cover 62. The rubber collar 82 includes an annular portion 84 that defines a central bore 86, the apertures 80, and a raised cylindrical wall 88 that extends upwardly but does not engage the deflector 22. The rubber collar 82 is retained against the nozzle cover 62 by a rubber collar retainer 90, which is preferably an annulus that engages the tops of the bosses 78.

Figure 9:
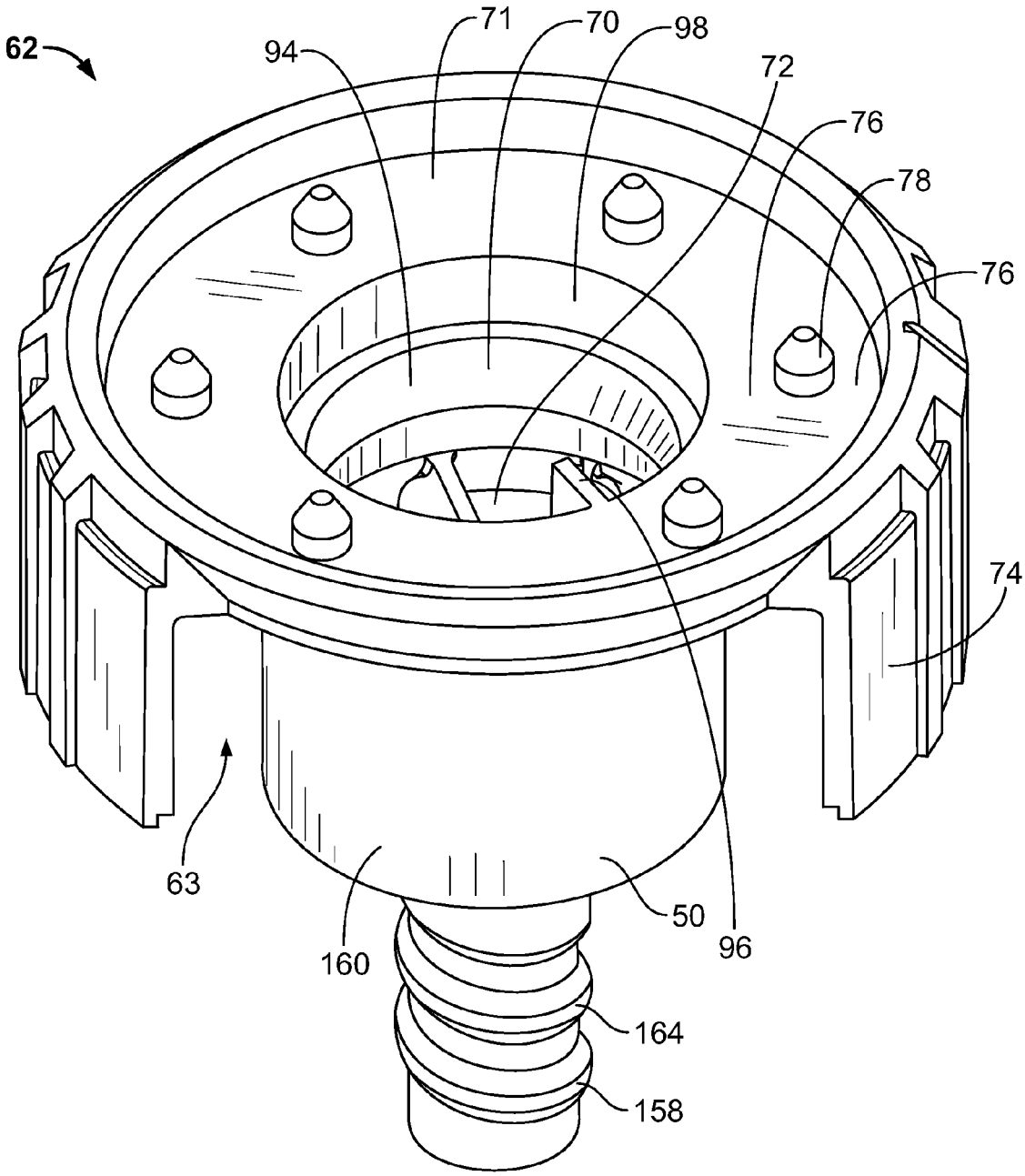
FIG. 9 is a top perspective view of the nozzle cover of the sprinkler head of FIG. 1.
Figure 12:
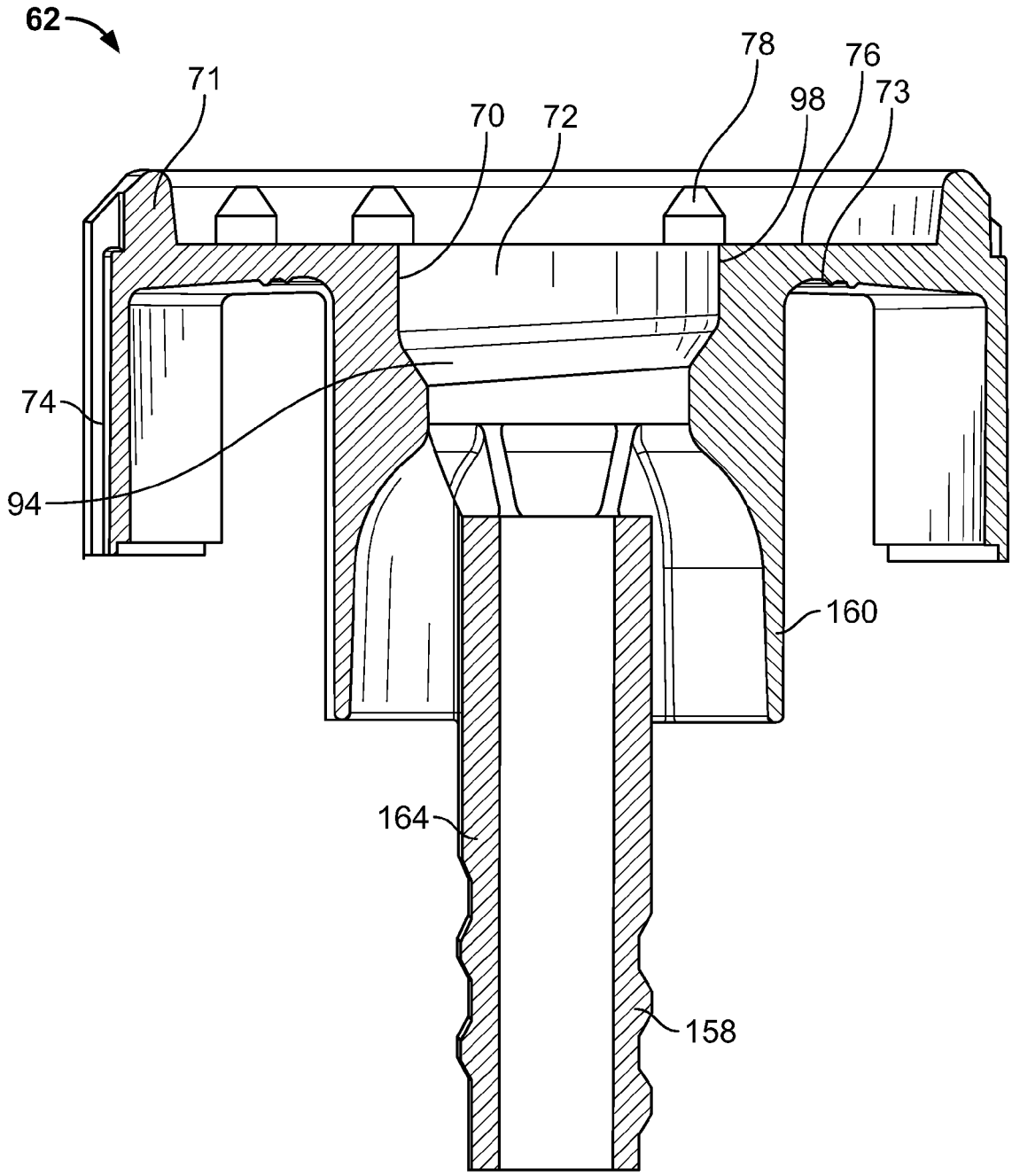
FIG. 12 is a cross-sectional view of the nozzle cover of the sprinkler head of FIG. 1.
Figure 13:
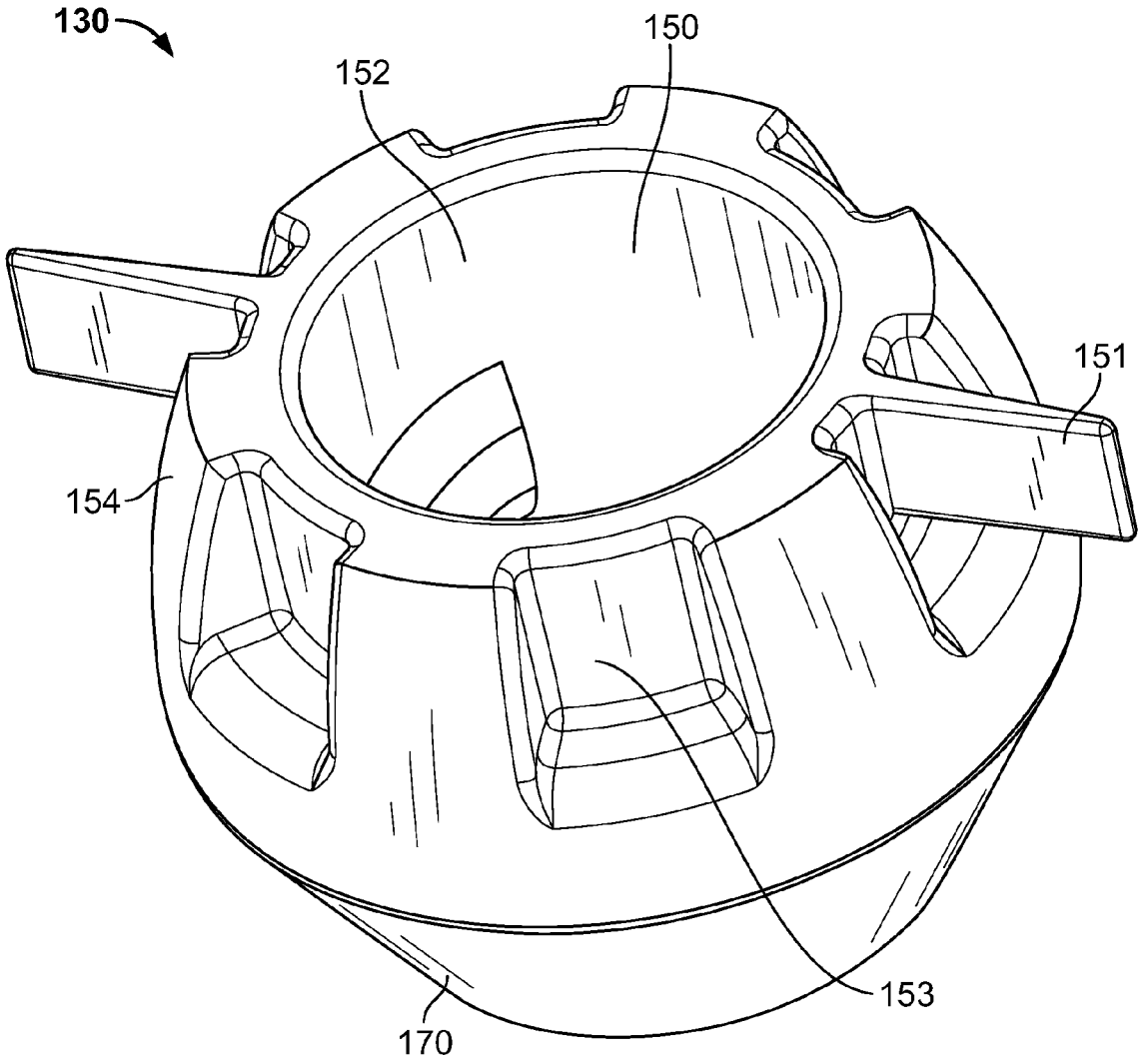
FIG. 13 is a top perspective view of the flow control member of the sprinkler head of FIG. 1.

As shown in FIGS. 9 and 12, the central hub 70 of the non-rotating nozzle cover 62 has an internal helical surface 94 that defines approximately one 360 degree helical revolution, or pitch. The ends are axially offset and joined by a fin 96, which projects radially inwardly from the central hub 70. The central hub 70 extends upwardly from the internal helical surface 94 into a raised cylindrical wall 98 with the fin 96 extending axially along the cylindrical wall 98.

Figure 2:
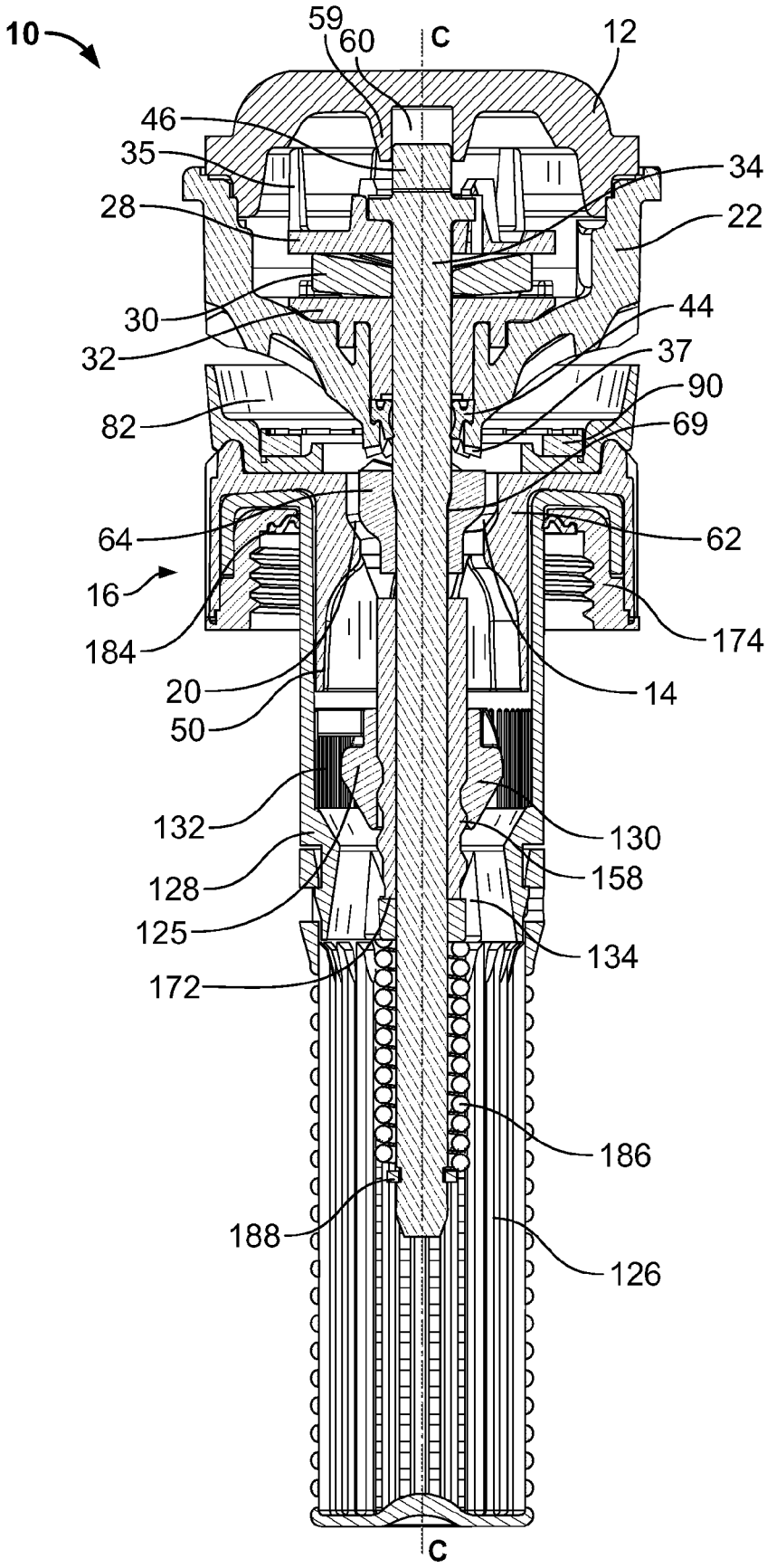
FIG. 2 is a cross-sectional view of the sprinkler head of FIG. 1.

The arcuate span of the sprinkler head 10 is determined by the relative positions of the internal helical surface 94 of the nozzle cover 62 and the complementary external helical surface 118 of the valve sleeve 64, which act together to form the arcuate slot 20. The camming interaction of the valve sleeve 64 with the nozzle cover 62 forms the arcuate slot 20, as shown in FIG. 2, where the arc is open on both sides of the C-C axis. The length of the arcuate slot 20 is determined by push down and rotation of the cap 12 (which in turn rotates the valve sleeve 64) relative to the non-rotating nozzle cover 62. The valve sleeve 64 may be rotated with respect to the nozzle cover 62 along the complementary helical surfaces through approximately one helical pitch to raise or lower the valve sleeve 64. The valve sleeve 64 may be rotated through approximately one 360 degree helical pitch with respect to the nozzle cover 62. The valve sleeve 64 may be rotated relative to the nozzle cover 62 to any arc desired by the user and is not limited to discrete arcs, such as quarter-circle and half-circle. As indicated above, although the arcuate slot 20 is generally adjustable through an entire 360 degree range, water flowing through the slot 20 may not be adequate to impart sufficient force for desired rotation of the deflector 22 when the slot 20 is set at relatively low angles.

In an initial lowermost position, the valve sleeve 64 is at the lowest point of the helical turn on the nozzle cover 62 and completely obstructs the flow path through the arcuate slot 20. As the valve sleeve 64 is rotated in the clockwise direction, however, the complementary external helical surface 118 of the valve sleeve 64 begins to traverse the helical turn on the internal surface 94 of the nozzle cover 62. As it begins to traverse the helical turn, a portion of the valve sleeve 64 is spaced from the nozzle cover 62 and a gap, or arcuate slot 20, begins to form between the valve sleeve 64 and the nozzle cover 62. This gap, or arcuate slot 20, provides part of the flow path for water flowing through the sprinkler head 10. The angle of the arcuate slot 20 increases as the valve sleeve 64 is further rotated clockwise and the valve sleeve 64 continues to traverse the helical turn. The valve sleeve 64 may be rotated clockwise until the rotating fin 114 on the valve sleeve 64 engages the fixed fin 96 on the nozzle cover 62. At this point, the valve sleeve 64 has traversed the entire helical turn and the angle of the arcuate slot 20 is substantially 360 degrees. In this position, water is distributed in a full circle arcuate span from the sprinkler head 10.

When the valve sleeve 64 is rotated counterclockwise, the angle of the arcuate slot 20 is decreased. The complementary external helical surface 118 of the valve sleeve 64 traverses the helical turn in the opposite direction until it reaches the bottom of the helical turn. When the surface 118 of the valve sleeve 64 has traversed the helical turn completely, the arcuate slot 20 is closed and the flow path through the sprinkler head 10 is completely or almost completely obstructed. Again, the fins 96 and 114 prevent further rotation of the valve sleeve 64. It should be evident that the direction of rotation of the valve sleeve 64 for either opening or closing the arcuate slot 20 can be easily reversed, i.e., from clockwise to counterclockwise or vice versa, such as by changing the thread orientation.

The sprinkler head 10 preferably allows for over-rotation of the cap 12 without damage to sprinkler components, such as fins 96 and 114. More specifically, the deflector teeth 37 and valve sleeve teeth 66 are preferably sized and dimensioned such that continued rotation of the cap 12 past the point of engagement of the fins 96 and 114 results in slippage of the teeth 37 out of the teeth 66. Thus, the user can continue to rotate the cap 12 without resulting in increased, and potentially damaging, force on fins 96 and 114.

When the valve sleeve 64 has been rotated to form the open arcuate slot 20, water passes through the arcuate slot 20 and impacts the raised cylindrical wall 98. The wall 98 redirects the water exiting the arcuate slot 20 in a generally vertical direction. Water exits the slot 20 and impinges upon the deflector 22 causing rotation and distribution of water through an arcuate span determined by the angle of the arcuate slot 20. The valve sleeve 64 may be adjusted to increase or decrease the angle and thereby change the arc of the water distributed by the sprinkler head 10, as desired. Where the valve sleeve 64 is set to a low angle, however, the sprinkler may be in a condition in which water passing through the slot 20 is not sufficient to cause desired rotation of the deflector 22.

In the embodiment shown in FIGS. 1-4, the valve sleeve 64 and nozzle cover 62 preferably engage each other to permit water flow with relatively undiminished velocity as water exits the arcuate slot 20. More specifically, the valve sleeve 64 includes a gently curved, radiused segment 116 that is preferably oriented to curve gradually radially outward to reduce the loss of velocity as water impacts the segment 116. As water passes through the arcuate slot 20, it impacts the segment 116 obliquely and then the cylindrical wall 98 obliquely, rather than at right angles, thereby reducing the loss of energy to maximize water velocity. The cylindrical wall 98 then redirects the water generally vertically to the underside of the deflector 22, where it is, in turn, redirected to surrounding terrain.

As shown in FIGS. 6-10, the sprinkler head 10 employs fins 96 and 114 to enhance and create uniform water distribution at the edges of the angular slot 20. As described above, one fin 96 projects inwardly from the nozzle cover 62 and the other fin 114 projects outwardly from the valve sleeve 64. The valve sleeve fin 114 rotates with the valve sleeve 64 while the nozzle cover fin 62 does not rotate. Each fin 96 and 114 extends both radially and axially a sufficient length to increase the axial flow component and reduce the tangential flow component, producing a well-defined edge to the water passing through the angular slot 20. The fins 96 and 114 are sized to allow for rotatable adjustment of the valve sleeve 64 within the bore 72 of the nozzle cover 62 while maintaining a seal.

The fins 96 and 114 define a relatively long axial boundary to channel the flow of water exiting the arcuate slot 20. This long axial boundary reduces the tangential components of flow along the boundary formed by the fins 96 and 114. Also, as shown in FIGS. 6-10, the fins 96 and 114 extend radially to reduce the tangential flow component. The valve sleeve fin 114 extends radially outwardly so that it preferably engages the inner surface of the nozzle cover hub 70. The nozzle cover fin 96 extends radially inwardly so that it preferably engages the outer surface of the valve sleeve 64. By extending the fins radially, water substantially cannot leak into the gaps that would otherwise exist between the valve sleeve 64 and nozzle cover 62. Water leaking into such gaps would otherwise provide a tangential flow component that would interfere with water flowing in an axial direction to the deflector 22. The fins 96 and 114 therefore reduce this tangential component.

Unlike previous designs, the sprinkler head 10 includes a spring 186 mounted near the lower end of the shaft 34 that downwardly biases the shaft 34. In turn, the shaft shoulder 69 exerts a downward force on the valve sleeve 64 for pressed fit engagement with the nozzle cover 62, as can be seen in FIGS. 2-4. Spring 186 is preferably a coil spring mounted about the lower end of the shaft 34, although other types of springs or elastic members may be used. The spring 186 preferably extends between a retaining ring 188 at one end and the inlet 134 at the other end. Optionally, the sprinkler head may include a washer mounted between the spring 186 and the retaining ring 188. The spring 186 provides a downward biasing force against the shaft 34 that is transmitted to the valve sleeve 64. In this manner, the spring 186 functions to energize the engagement between the helical surfaces that form the arc adjustment valve 14.

Spring 186 also allows for a convenient way of flushing the sprinkler head 10. More specifically, a user may pull up on the cap 12 and deflector 22 to compress the spring 186 and run fluid through the sprinkler head 10. This upward force by the user on the cap 12 and deflector 22 allows the valve sleeve 64 to be spaced above the nozzle cover 62. The fluid will flush grit and debris that is trapped in the body of the sprinkler head 10, especially debris that may be trapped in the narrow arcuate slot 20 and between the valve sleeve 64 and the upper cylindrical wall of the nozzle cover 62. Following flushing, spring 186 returns valve sleeve 64 to its non-flushing position. This arrangement of parts also prevents removal and possible misplacement of the cap 12 and deflector 22.

This flushing aspect of the sprinkler also reduces a water hammer effect that may cause damage to sprinkler components during start up or shut down of the sprinkler. This water hammer effect can result due to the decrease in flow area as water approaches valve 20, which may be in a completely closed position. This decrease in flow area can cause a sudden pressure spike greater than the upstream pressure. More specifically, the pressure spike in the upstream pressure can be caused as the motion energy in the flowing fluid is abruptly converted to pressure energy acting on the valve 20. This pressure spike can cause the valve 20 to experience a water hammer effect, which can undesirably result in increased stress on the components of the valve 20, as well as other components of the irrigation system, and can lead to premature failure of the components. The elasticity of the spring 186 is preferably selected so that the valve sleeve 64 can overcome the bias of the spring 186 in order to be spaced above the nozzle cover 62 during a pressure spike to relieve a water hammer effect. In other words, the sprinkler head 10 essentially self-flushes during a pressure spike.

This spring arrangement also improves the concentricity of the valve sleeve 64. More specifically, the valve sleeve 64 has a long axial boundary with the shaft 34 and is in press fit engagement with the shaft 34. This spring arrangement thereby provides a more uniform radial width of the arcuate slot 20, regardless of the arcuate length of the slot 20. It makes the sprinkler head 10 more resistant to side load forces on the valve 20 that might otherwise result in a non-uniform radial width and an uneven water distribution. In addition, the mounting of the spring 186 at the bottom of the sprinkler head 10 also allows for easier assembly, unlike previous designs.

Figure 28:
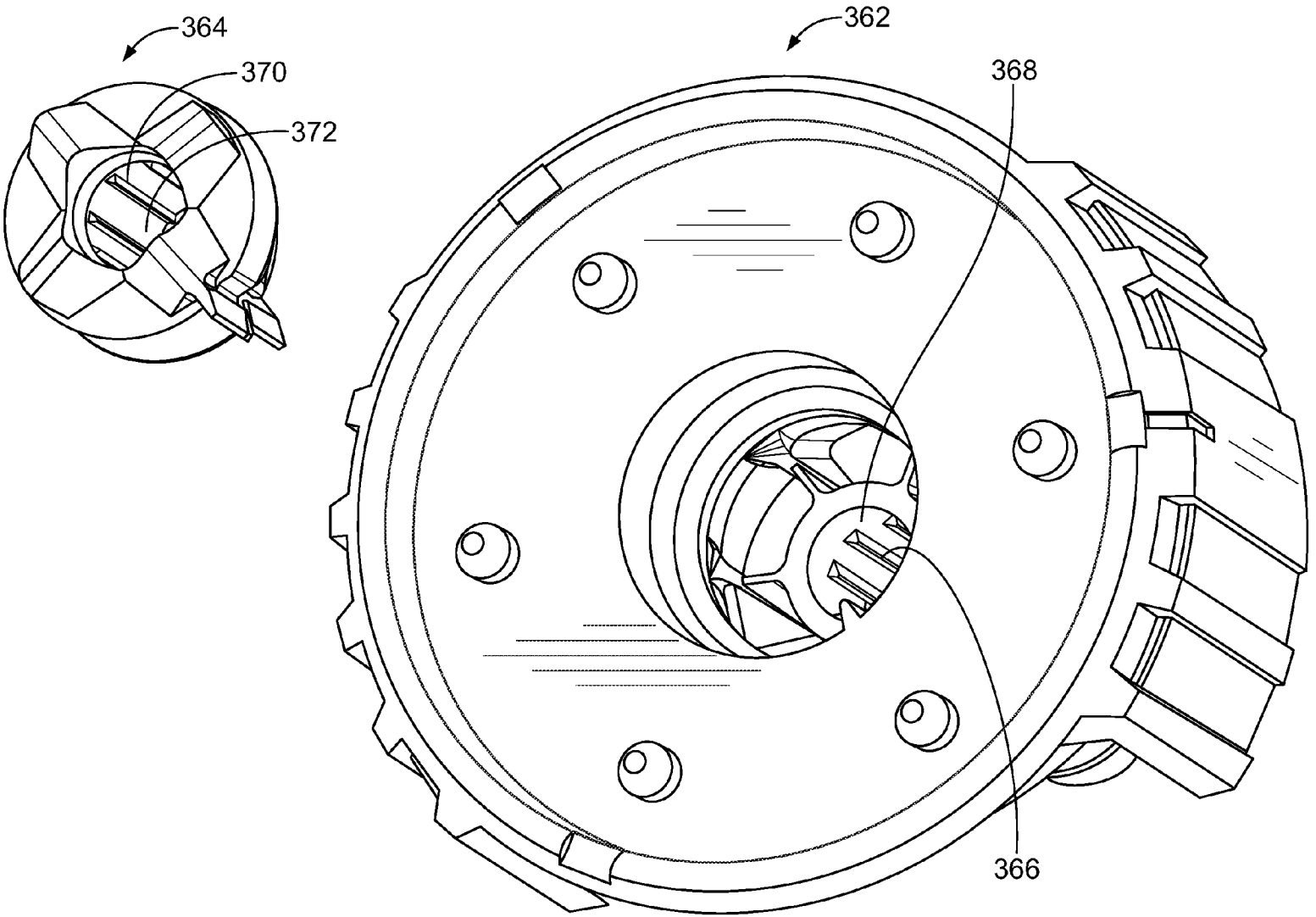
FIG. 28 is a top perspective view of an alternative valve sleeve and alternative nozzle cover for use with the sprinkler head of FIG. 1.

Alternative preferred forms of nozzle cover 362 and valve sleeve 364 for use with sprinkler head 10 are shown in FIGS. 28 and 29 and provide additional improved concentricity. As can be seen, nozzle cover 362 includes circumferentially-arranged and equidistantly-spaced crush ribs 366 that extend axially along the inside of the central hub 368. Similarly, valve sleeve 364 includes circumferentially-arranged and equidistantly-spaced crush ribs 370 that extend axially along the inside of the central hub 372. These crush ribs 366 and 370 engage the shaft 34 and help keep the nozzle cover 362 and valve sleeve 364 centered with respect to the shaft 34. These crush ribs 366 and 370 allow for variations in manufacturing and allow for greater tolerances in the manufacture of the nozzle cover 362 and valve sleeve 364. It is desirable to have the nozzle cover 362 and valve sleeve 364 centered as much as practicable with respect to the shaft 34 to maintain a uniform width of the arcuate slot 20. The nozzle cover 362 and valve sleeve 364 are otherwise generally similar in structure to nozzle cover 62 and valve sleeve 64, except as shown in FIGS. 28 and 29.

As shown in FIG. 2, the sprinkler head 10 also preferably includes a flow rate adjustment valve 125. The flow rate adjustment valve 125 can be used to selectively set the water flow rate through the sprinkler head 10, for purposes of regulating the range of throw of the projected water streams. It is adapted for variable setting through use of a rotatable segment 124 located on an outer wall portion of the sprinkler head 10. It functions as a second valve that can be opened or closed to allow the flow of water through the sprinkler head 10. Also, a filter 126 is preferably located upstream of the flow rate adjustment valve 125, so that it obstructs passage of sizable particulate and other debris that could otherwise damage the sprinkler components or compromise desired efficacy of the sprinkler head 10.

As shown in FIGS. 9-17, the flow rate adjustment valve structure preferably includes a nozzle collar 128, a flow control member 130, and the hub portion 50 of the nozzle cover 62. The nozzle collar 128 is rotatable about the central axis C-C of the sprinkler head 10. It has an internal engagement surface 132 and engages the flow control member 130 so that rotation of the nozzle collar 128 results in rotation of the flow control member 130. The flow control member 130 also engages the hub portion 50 of the nozzle cover 62 such that rotation of the flow control member 130 causes it to move in an axial direction, as described further below. In this manner, rotation of the nozzle collar 128 can be used to move the flow control member 130 axially closer to and further away from an inlet 134. When the flow control member 130 is moved closer to the inlet 134, the flow rate is reduced. The axial movement of the flow control member 130 towards the inlet 134 increasingly pinches the flow through the inlet 134. When the flow control member 130 is moved further away from the inlet 134, the flow rate is increased. This axial movement allows the user to adjust the effective throw radius of the sprinkler head 10 without disruption of the streams dispersed by the deflector 22.

Figure 16:
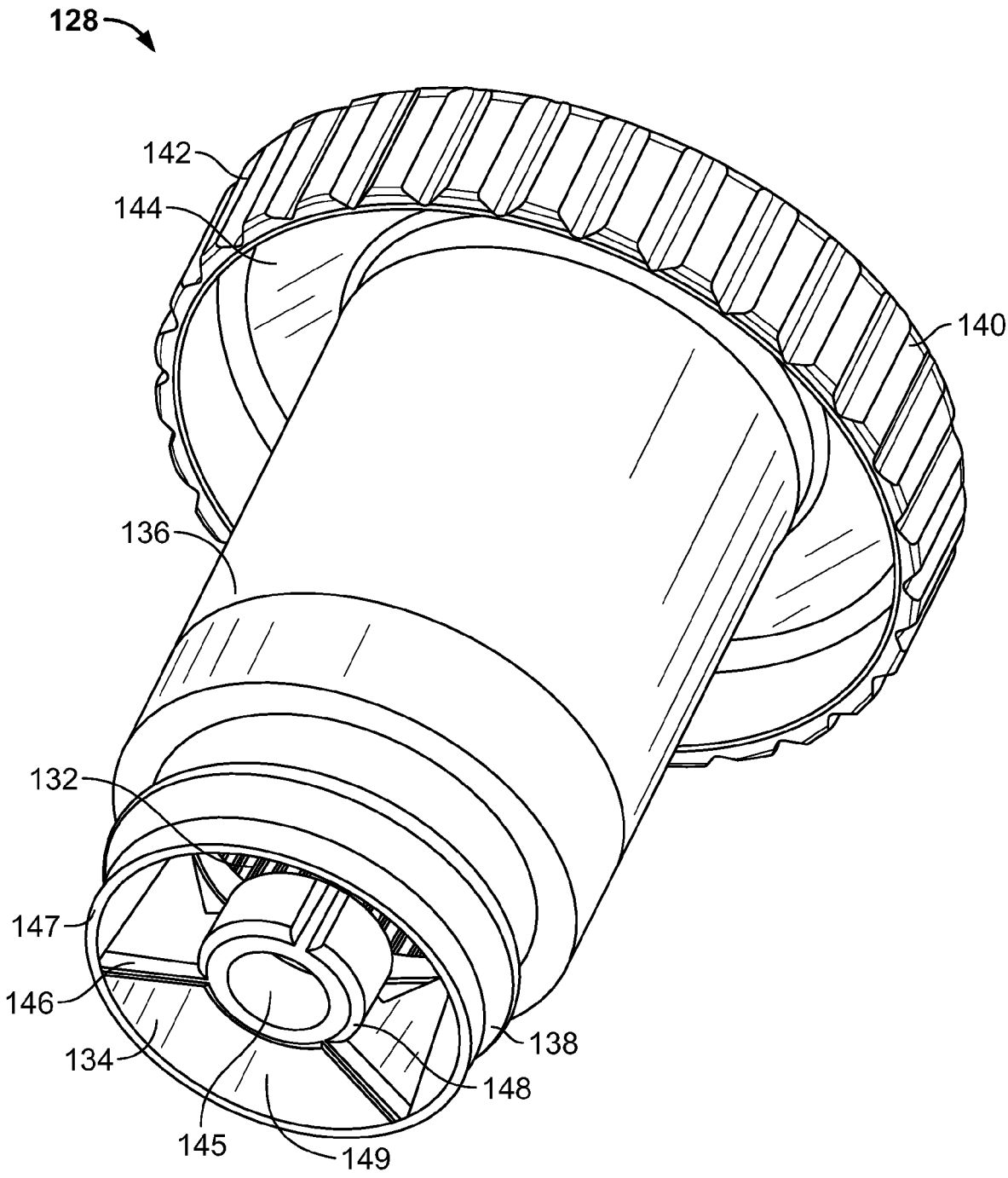
FIG. 16 is a perspective view of the collar of the sprinkler head of FIG. 1.
Figure 17:
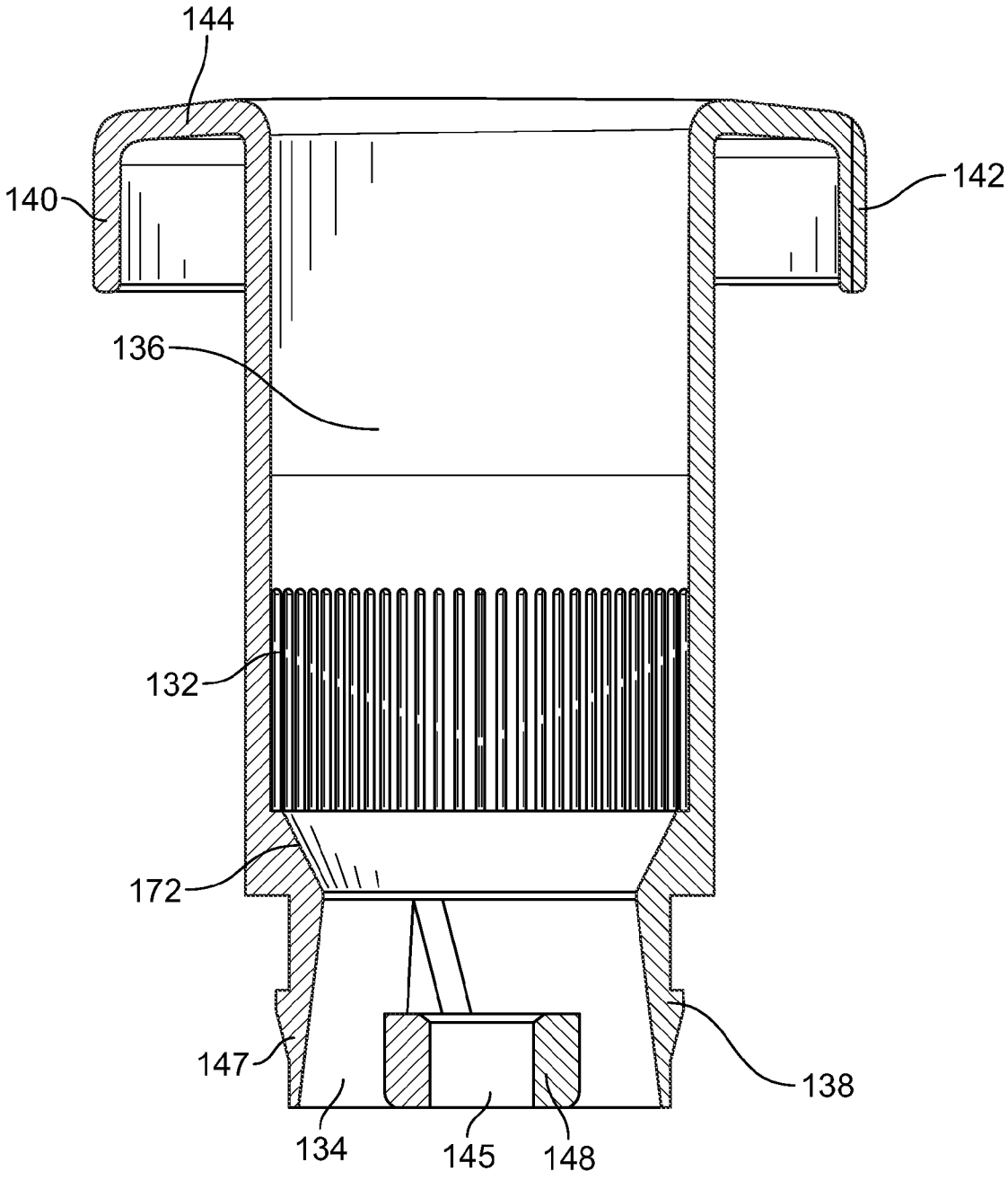
FIG. 17 is a cross-sectional view of the collar of the sprinkler head of FIG. 1.
Figure 18:
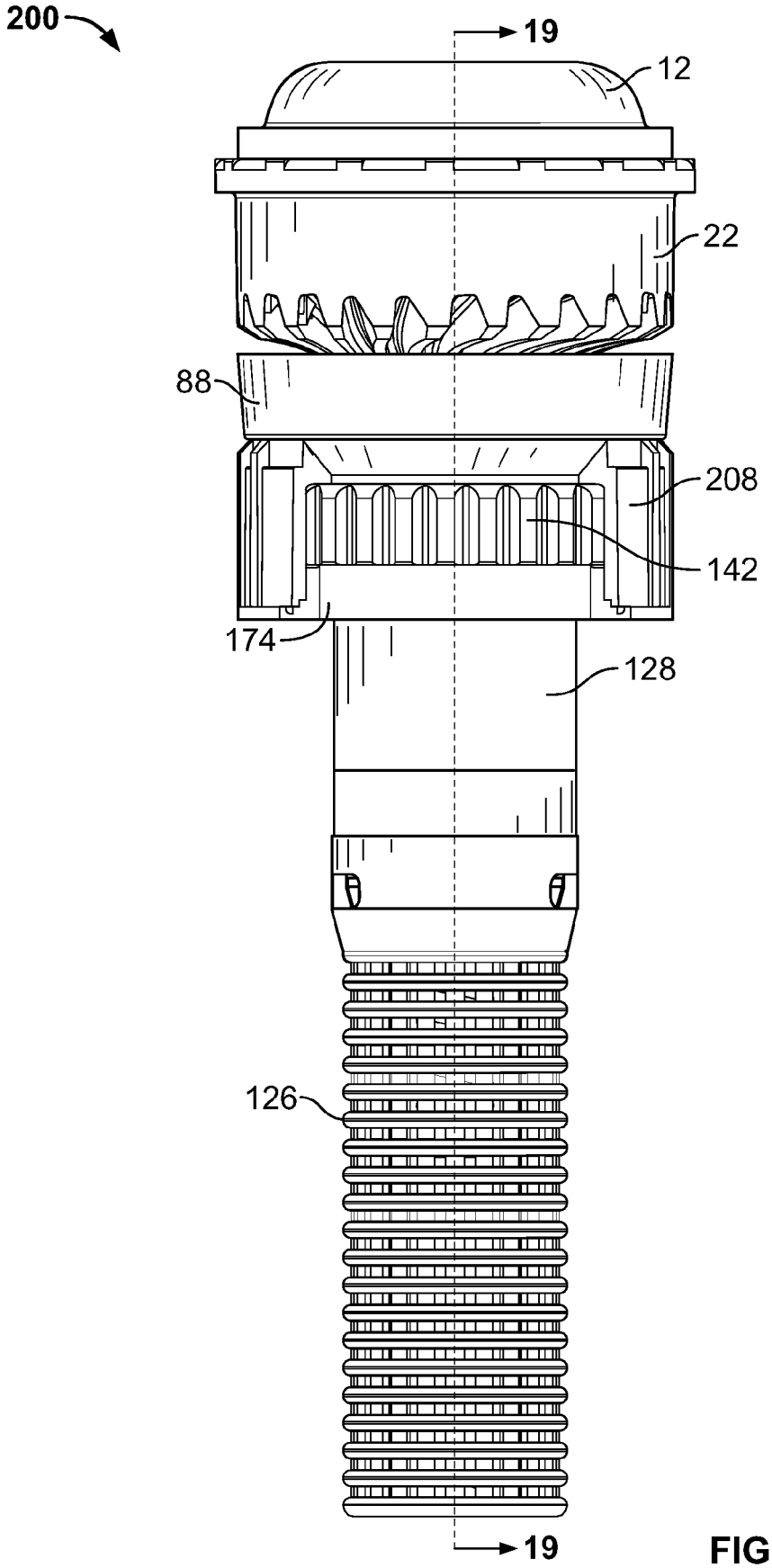
FIG. 18 is a perspective view of a second embodiment of a sprinkler head embodying features of the present invention.
Figure 19:
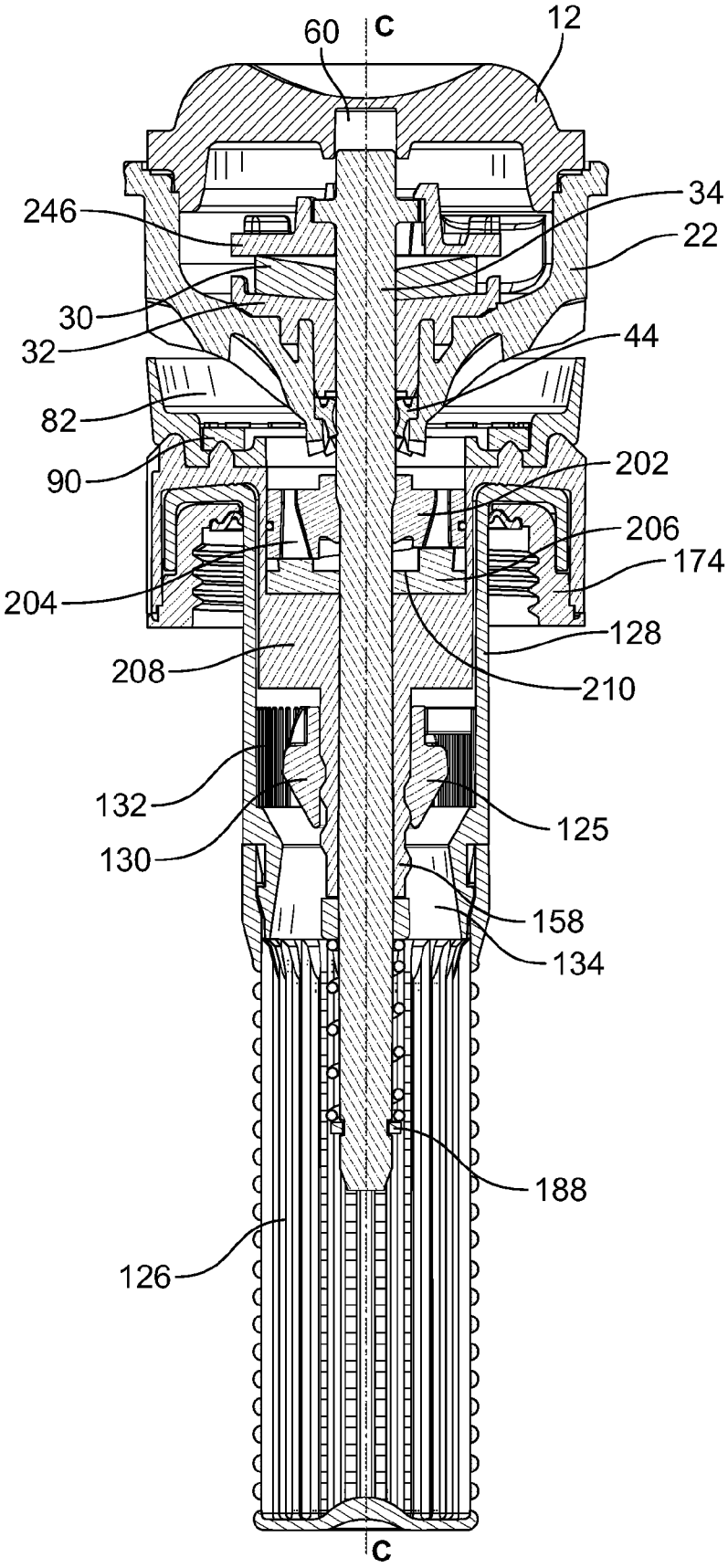
FIG. 19 is a cross-sectional view of the sprinkler head of FIG. 18.

As shown in FIGS. 16-17, the nozzle collar 128 preferably includes a first cylindrical portion 136 and a second cylindrical portion 138 having a smaller diameter than the first portion 136. The first portion 136 has an engagement surface 132, preferably a splined surface, on the interior of the cylinder. The nozzle collar 128 preferably also includes an outer wall 140 having an external grooved surface 142 for gripping and rotation by a user that is joined by an annular portion 144 to the first cylindrical portion 136. In turn, the first cylindrical portion 136 is joined to the second cylindrical portion 138, which is essentially the inlet 134 for fluid flow into the nozzle body 16. Water flowing through the inlet 134 passes through the interior of the first cylindrical portion 136 and through the remainder of the nozzle body 16 to the deflector 22. Rotation of the outer wall 140 causes rotation of the entire nozzle collar 128.

The second cylindrical portion 138 defines a central bore 145 for insertion of the shaft 34 therethrough. Unlike previous designs, the shaft 34 extends through the second cylindrical portion 138 beyond the inlet 134 and into filter 126. In other words, the spring 186 is mounted on the lower end of the shaft 34 upstream of the inlet 134. The second cylindrical portion 138 also preferably includes ribs 146 that connect an outer cylindrical wall 147 to an inner cylindrical wall 148 that defines the central bore 145. These ribs 146 define flow passages 149 therebetween.

Figure 15:
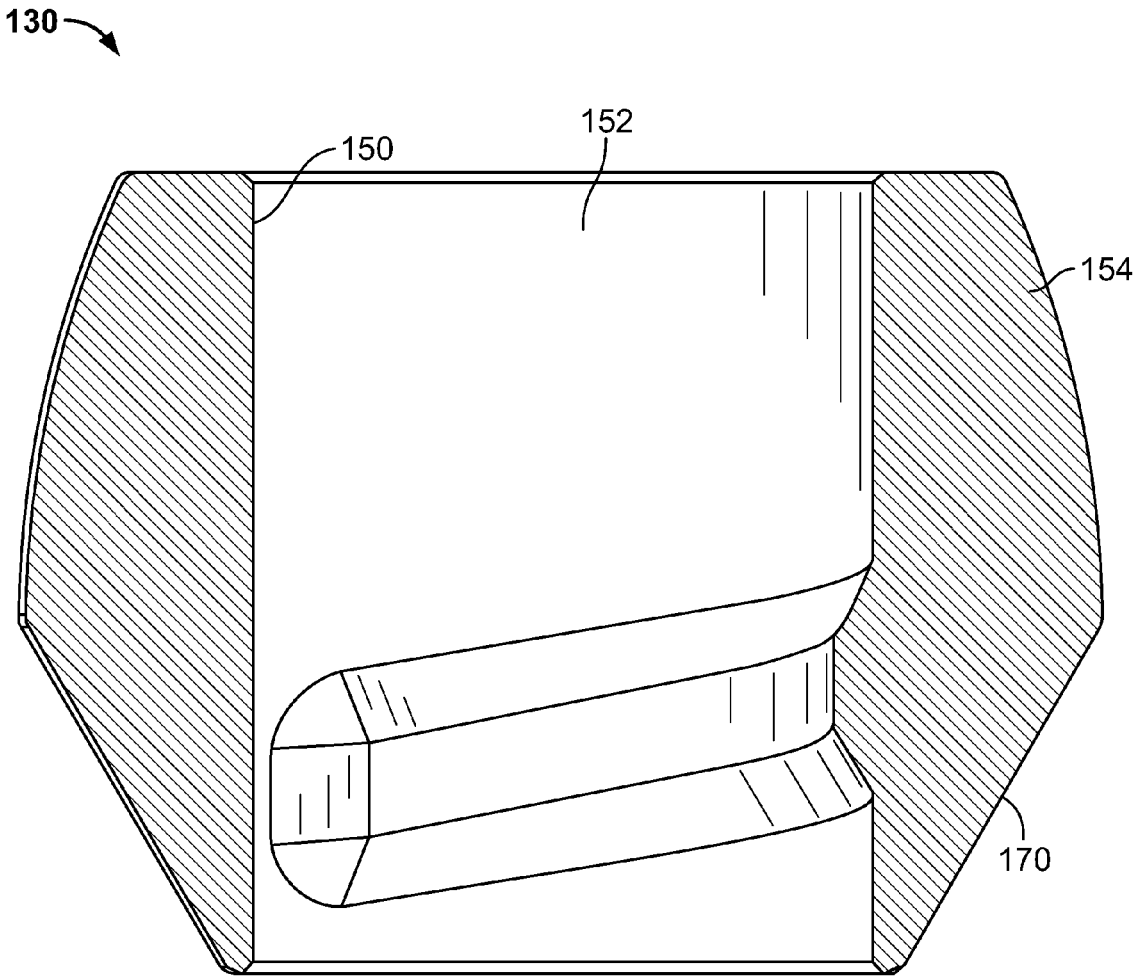
FIG. 15 is a cross-sectional view of the flow control member of the sprinkler head of FIG. 1.

The nozzle collar 128 is coupled to a flow control member 130. As shown in FIGS. 15-17, the flow control member 130 is preferably in the form of a ring-shaped nut with a central hub 150 defining a central bore 152. The flow control member 130 has an external surface 154 with two thin tabs 151 extending radially outward for engagement with the corresponding internal splined surface 132 of the nozzle collar 128. The tabs 151 and internal splined surface 132 interlock such that rotation of the nozzle collar 128 causes rotation of the flow control member 130 about central axis C-C. The external surface 154 has cut-outs 153, preferably six, in the top end of the member 130 to equalize upward fluid flow, as described below. Although certain engagement surfaces are shown in the preferred embodiment, it should be evident that other engagement surfaces, such as threaded surfaces, could be used to cause the simultaneous rotation of the nozzle collar 128 and flow control member 130.

In turn, the flow control member 130 is coupled to the hub portion 50 of the nozzle cover 62. More specifically, the flow control member 130 is internally threaded for engagement with an externally threaded hollow post 158 at the lower end of the nozzle cover 62. Rotation of the flow control member 130 causes it to move along the threading in an axial direction. In one preferred form, rotation of the flow control member 130 in a counterclockwise direction advances the member 130 towards the inlet 134 and away from the deflector 22. Conversely, rotation of the flow control member 130 in a clockwise direction causes the member 130 to move away from the inlet 134. Although threaded surfaces are shown in the preferred embodiment, it is contemplated that other engagement surfaces could be used to effect axial movement.

As shown in FIGS. 9-12, the nozzle cover hub portion 50 preferably includes an outer cylindrical wall 160 joined by spoke-like ribs 162 to an inner cylindrical wall 164. The inner cylindrical wall 164 preferably defines the bore 72 to accommodate insertion of the shaft 34 therein. The lower end forms the external threaded hollow post 158 for insertion in the bore 152 of the flow control member 130, as discussed above. The ribs 162 define flow passages 168 to allow fluid flow upwardly through the remainder of the sprinkler head 10.

The flow passages 168 are preferably spaced directly above the cut-outs 153 of the flow control member 130 when the member 130 is at its highest axial point, i.e., is fully open. This arrangement equalizes fluid flow through the flow passages 168 when the valve 125 is in the fully open position, which is the position most frequently used during irrigation. This equalization is especially desirable given the close proximity of the flow control member 130 to the ribs 162 and flow passages 168 at this highest axial point.

Figure 10:
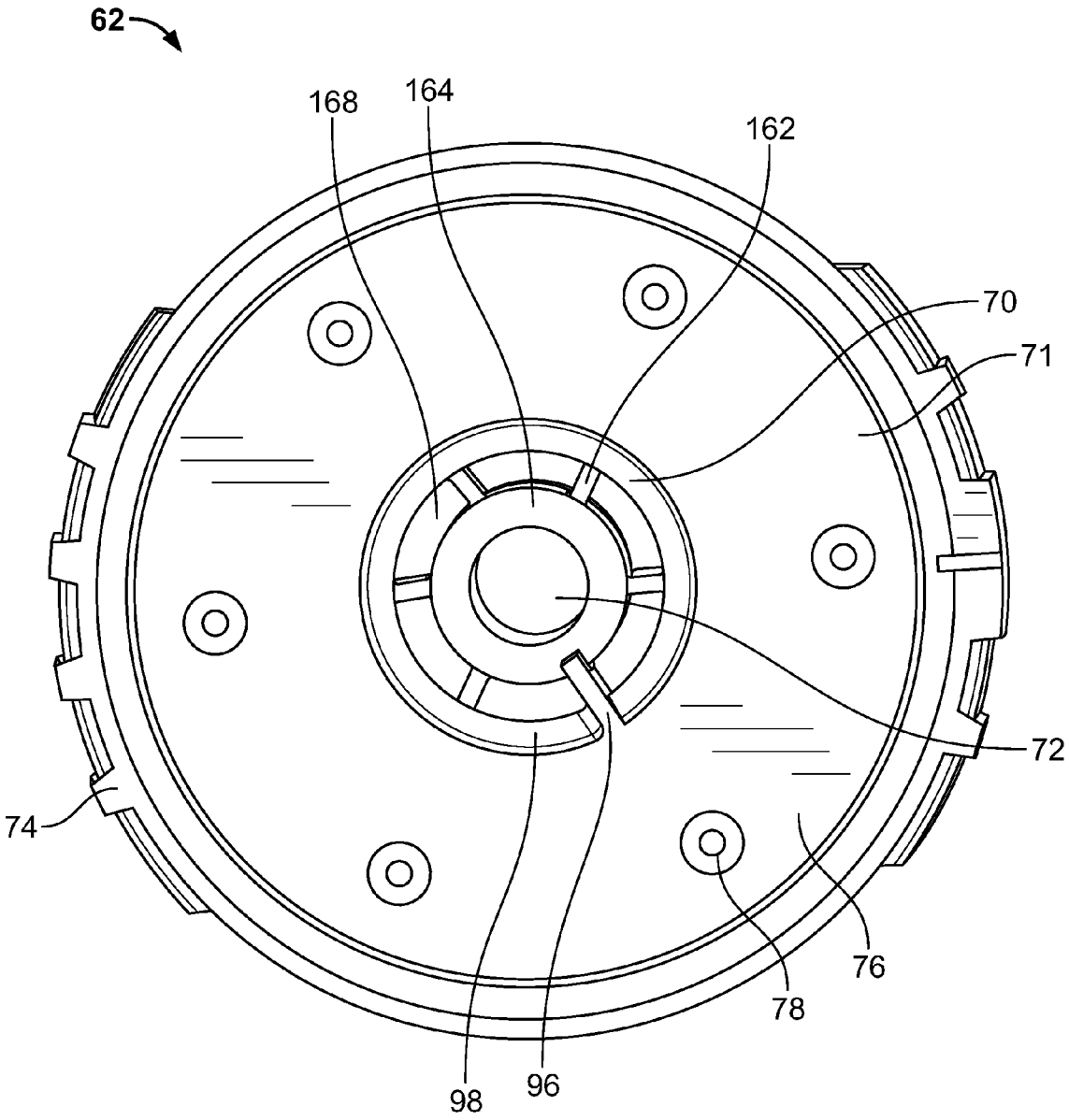
FIG. 10 is a top plan view of the nozzle cover of the sprinkler head of FIG. 1.
Figure 14:
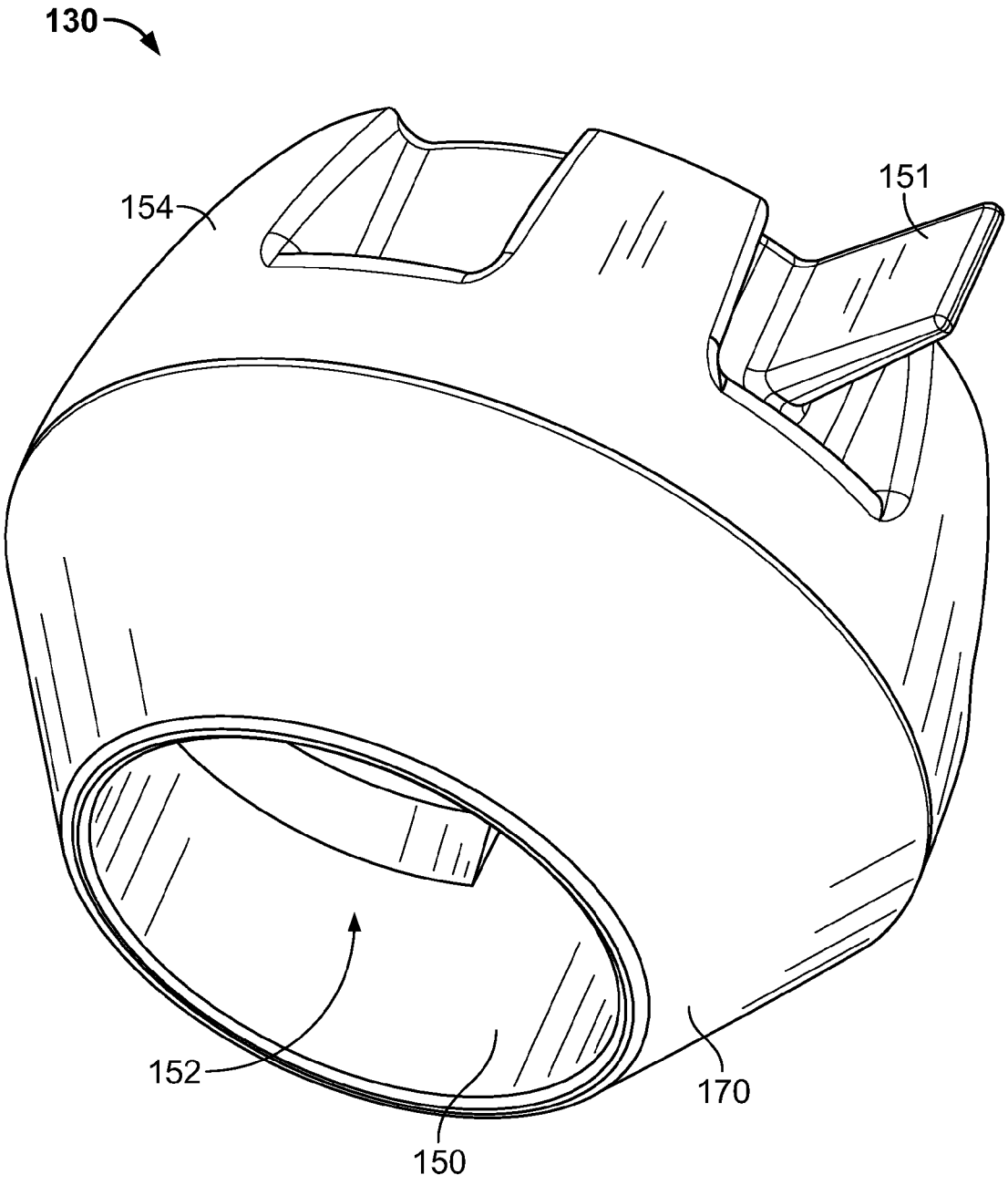
FIG. 14 is a bottom perspective view of the flow control member of the sprinkler head of FIG. 1.

In operation, a user may rotate the outer wall 140 of the nozzle collar 128 in a clockwise or counterclockwise direction. As shown in FIG. 10, the nozzle cover 62 preferably includes one or more cut-out portions 63 to define one or more access windows to allow rotation of the nozzle collar outer wall 140. Further, as shown in FIG. 2, the nozzle collar 128, flow control member 130, and nozzle cover hub portion 50 are oriented and spaced to allow the flow control member 130 and hub portion 50 to essentially block fluid flow through the inlet 134 or to allow a desired amount of fluid flow through the inlet 134. As can be seen in FIGS. 14-15, the flow control member 130 preferably has a contoured bottom surface 170 for engagement with the inlet 134 when fully extended.

Rotation in a counterclockwise direction results in axial movement of the flow control member 130 toward the inlet 134. Continued rotation results in the flow control member 130 advancing to a valve seat 172 formed at the inlet 134 for blocking fluid flow. The dimensions of the radial tabs 151 of the flow control member 130 and the splined internal surface 132 of the nozzle collar 128 are preferably selected to provide over-rotation protection. More specifically, the radial tabs 151 are sufficiently flexible such that they slip out of the splined recesses upon over-rotation. Once the inlet 134 is blocked, further rotation of the nozzle collar 128 causes slippage of the radial tabs 151, allowing the collar 128 to continue to rotate without corresponding rotation of the flow control member 130, which might otherwise cause potential damage to sprinkler components.

Rotation in a clockwise direction causes the flow control member 130 to move axially away from the inlet 134. Continued rotation allows an increasing amount of fluid flow through the inlet 134, and the nozzle collar 128 may be rotated to the desired amount of fluid flow. When the valve is open, fluid flows through the sprinkler head 10 along the following flow path: through the inlet 134, between the nozzle collar 128 and the flow control member 130, through the flow passages 168 of the nozzle cover 62, through the arcuate slot 20 (if set to an angle greater than 0 degrees), upwardly along the upper cylindrical wall 98 of the nozzle cover 62, to the underside surface of the deflector 22, and radially outwardly from the deflector 22. As noted above, water flowing through the slot 20 may not be adequate to impart sufficient force for desired rotation of the deflector 22, when the slot 20 is set at relatively low angles. It should be evident that the direction of rotation of the outer wall 140 for axial movement of the flow control member 130 can be easily reversed, i.e., from clockwise to counterclockwise or vice versa.

The sprinkler head 10 illustrated in FIGS. 2-4 also includes a nozzle base 174 of generally cylindrical shape with internal threading 176 for quick and easy thread-on mounting onto a threaded upper end of a riser with complementary threading (not shown). The nozzle base 174 preferably includes an upper cylindrical portion 178, a lower cylindrical portion 180 having a larger diameter than the upper portion 178, and a top annular surface 182. As can be seen in FIGS. 2-4, the top annular surface 182 and upper cylindrical portion 178 provide support for corresponding features of the nozzle cover 62. The nozzle base 174 and nozzle cover 62 are preferably attached to one another by welding, snap-fit, or other fastening method such that the nozzle cover 62 is relatively stationary when the base 174 is threadedly mounted to a riser. The sprinkler head 10 also preferably includes a seal member 184, such as an o-ring or lip seal, at the top of the internal threading 176 of the nozzle base 174 and about the outer cylindrical wall 140 of the nozzle collar 128 to reduce leaking when the sprinkler head 10 is threadedly mounted on the riser.

Figure 11:
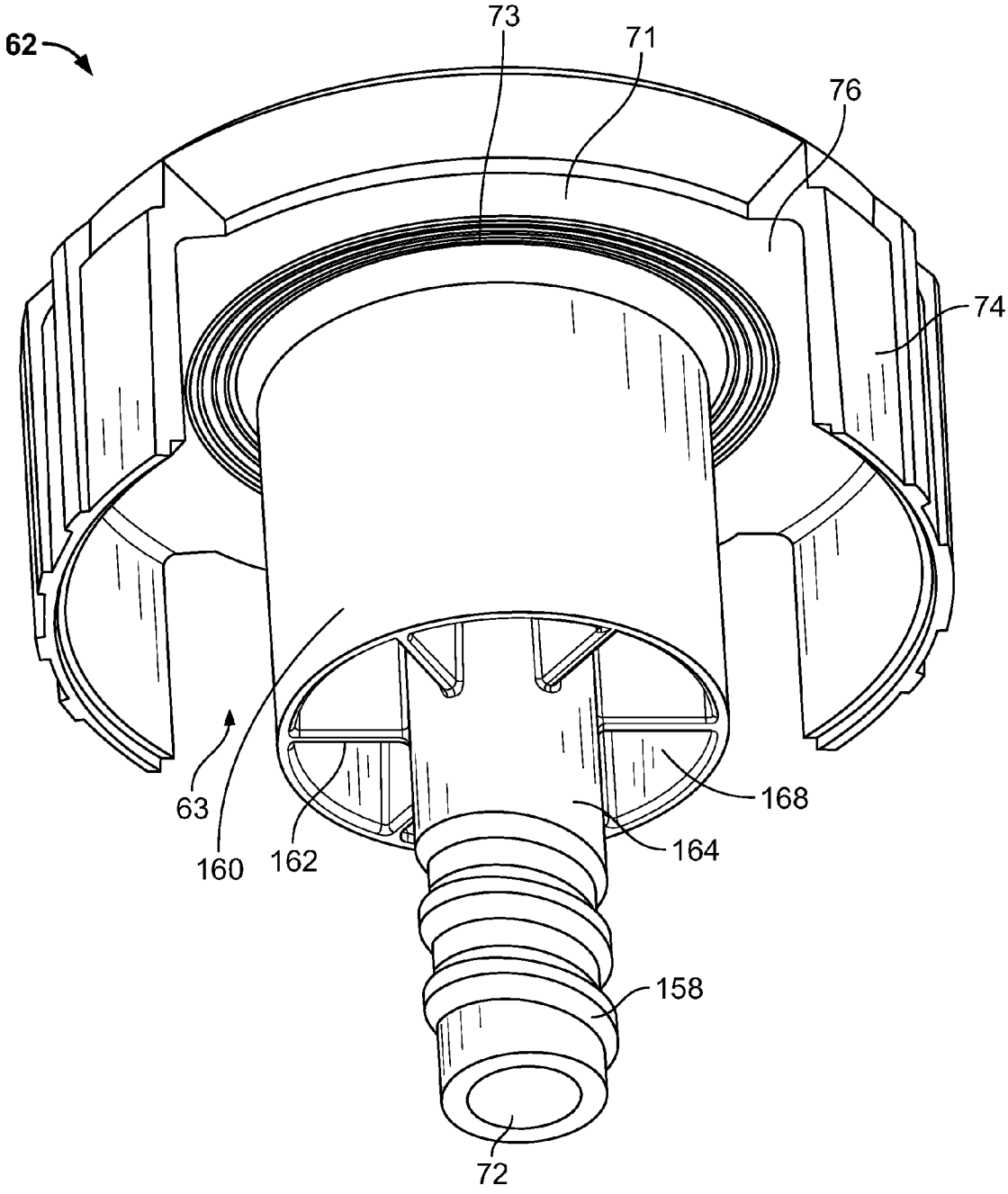
FIG. 11 is a bottom perspective view of the nozzle cover of the sprinkler head of FIG. 1.

The sprinkler head 10 preferably includes additional sealing engagement within the nozzle body 16. More specifically, as shown in FIG. 11, two concentric rings 73 protrude downwardly from the underside of the annular top surface 76 of the nozzle cover 62. These rings 73 engage the corresponding portion of the nozzle collar 128 to form a seal between nozzle cover 62 and nozzle collar 128. This seal is energized by spring 186, which exerts an upward biasing force against the nozzle collar 128 such that the nozzle collar is urged upwardly against the nozzle cover 62. The rings 73 reduce the amount of frictional contact between the nozzle cover 62 and collar 128 to allow relatively free rotation of the nozzle collar 128. The sprinkler head 10 preferably uses a plurality of rings 73 to provide a redundant seal.

A second preferred embodiment of the sprinkler head or nozzle 200 is shown in FIGS. 18-27. The second preferred embodiment of the sprinkler head 200 is similar to the one described above but includes a different arc adjustment valve 202. The second embodiment does not include the valve sleeve structure of the first embodiment, and the nozzle cover structure has been modified in the second embodiment. The valve sleeve structure has been replaced with two sequential arc valve pieces 204 and 206 having helical interfaces, as described further below. It should be understood that the structure of the second embodiment of the sprinkler head 200 is generally the same as that described above for the first embodiment, except to the extent described as follows.

The sequential arc valve 202 is preferably formed of two valve pieces—an upper helical valve portion 204 and a lower helical valve portion 206. Although the preferred form shown in FIGS. 18-27 uses two separate valve pieces, it should be evident that one integral valve piece may be used instead. Alternatively, the lower helical valve portion 206 may be formed as a part of the nozzle cover 208. The two valve pieces of the preferred form shown in FIGS. 18-27 are mounted in the top of the modified nozzle cover 208. The nozzle cover 208 is similar in structure to that of the first embodiment, but it does not include an internal helical surface or internal fin. Instead, the top portion of the nozzle cover 208 defines a substantially cylindrical recess 210 for receiving the upper helical valve portion 204 and the lower helical valve portion 206.

Figure 25:
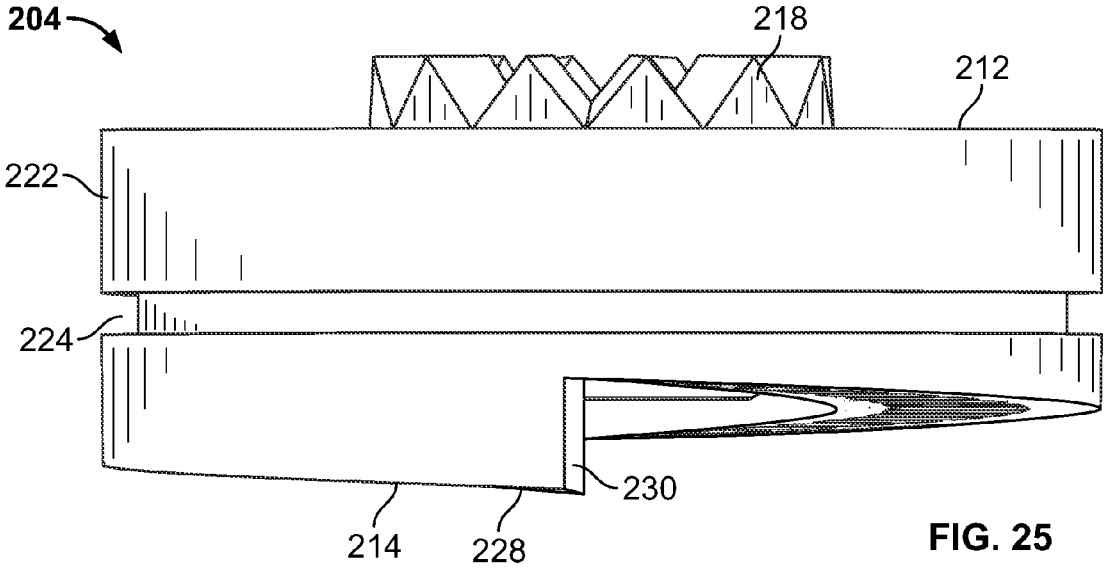
FIG. 25 is a side elevational view of the upper helical valve portion of the sprinkler head of FIG. 18.
Figure 26:
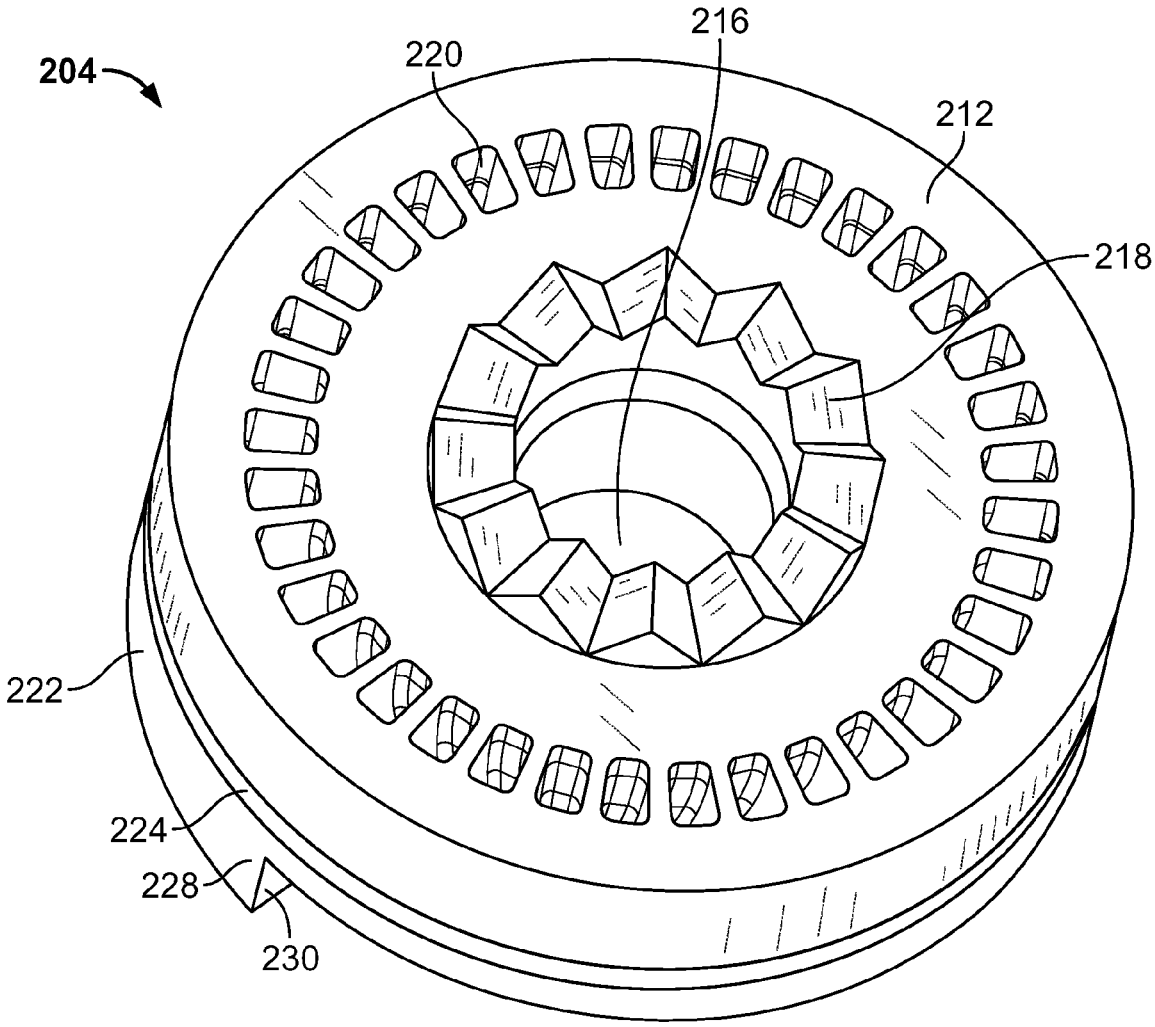
FIG. 26 is a top perspective view of the upper helical valve portion of the sprinkler head of FIG. 18.
Figure 27:
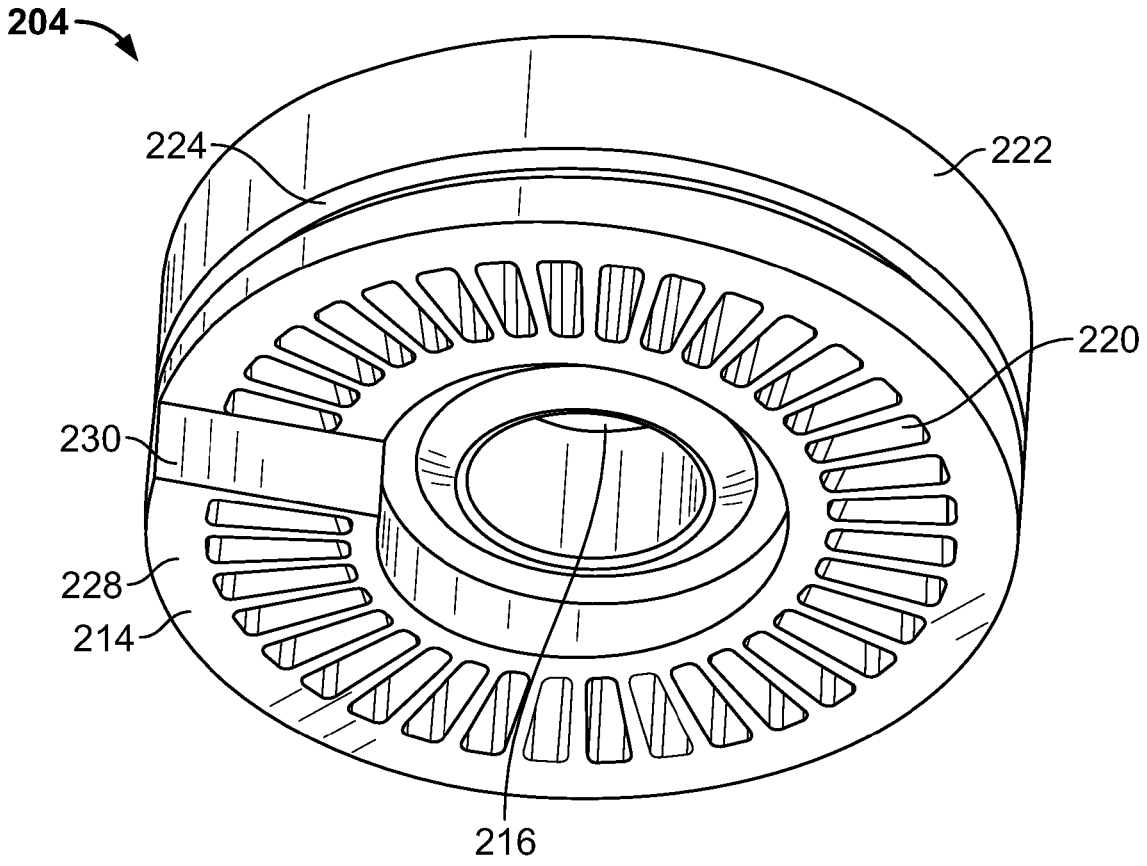
FIG. 27 is a bottom perspective view of the upper helical valve portion of the sprinkler head of FIG. 18.

As shown in FIGS. 25-27, the upper helical valve portion 204 has a substantially disk-like shape with a top surface 212, a bottom surface 214, and with a central bore 216 for insertion of the shaft 34 therethrough. The upper helical valve portion 204 further includes teeth 218 on its top surface 212 for receiving the deflector teeth 37, and, as with the first embodiment, a user pushes down the cap 12, which causes the deflector teeth 37 to engage the teeth 218 of the upper helical valve portion 204. Once engaged, the user rotates the cap 12 to set the arcuate length of the sequential arc valve 202.

The upper helical valve portion 204 also includes multiple apertures 220 that are circumferentially arranged about the disk and that extend through the body of the disk. These apertures 220 define flow passages for fluid flowing upwardly through the valve 202. In one preferred form, the cross-section of the apertures 220 is rectangular and decreases in size as fluid proceeds upwardly from the bottom to the top of the disk. This decrease in cross-section helps maintain relatively high pressure and velocity through the valve 202. In addition, the upper helical valve portion 204 includes an outer cylindrical wall 222, preferably with a groove 224 for receiving an o-ring 226 or other seal member.

As shown in FIGS. 25 and 27, the bottom surface 212 defines a first downwardly-facing, helical engagement surface 228 defining one helical revolution, or pitch. The ends are axially offset and form a vertical wall 230. The first helical engagement surface 228 engages a corresponding upwardly-facing, second helical engagement surface 232 on the lower helical valve portion 206, as described below, for opening and closing the sequential arc valve 202.

Figure 22:
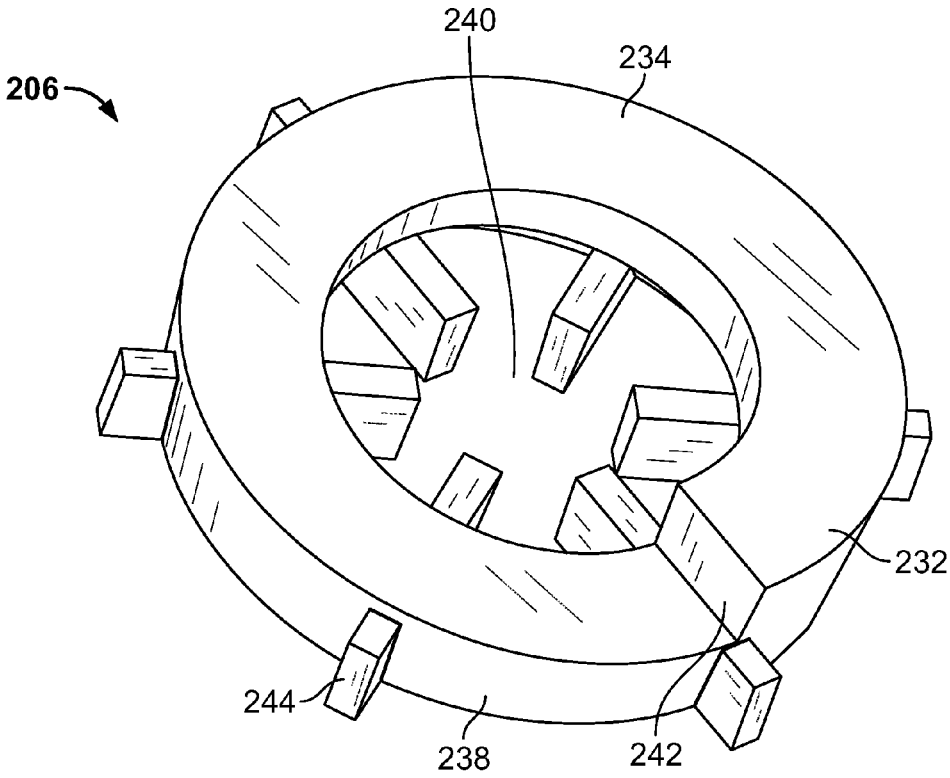
FIG. 22 is a top perspective view of the lower helical valve portion of the sprinkler head of FIG. 18.
Figure 23:
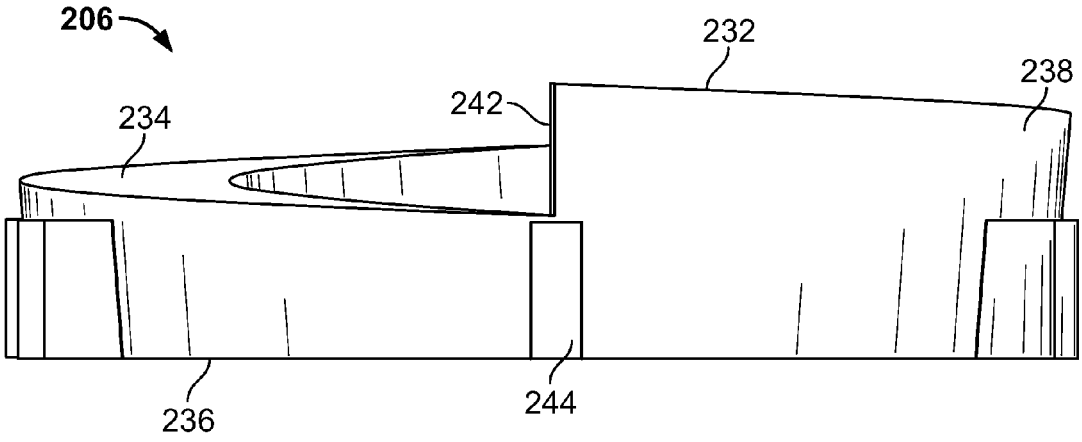
FIG. 23 is a side elevational view of the lower helical valve portion of the sprinkler head of FIG. 18.
Figure 24:
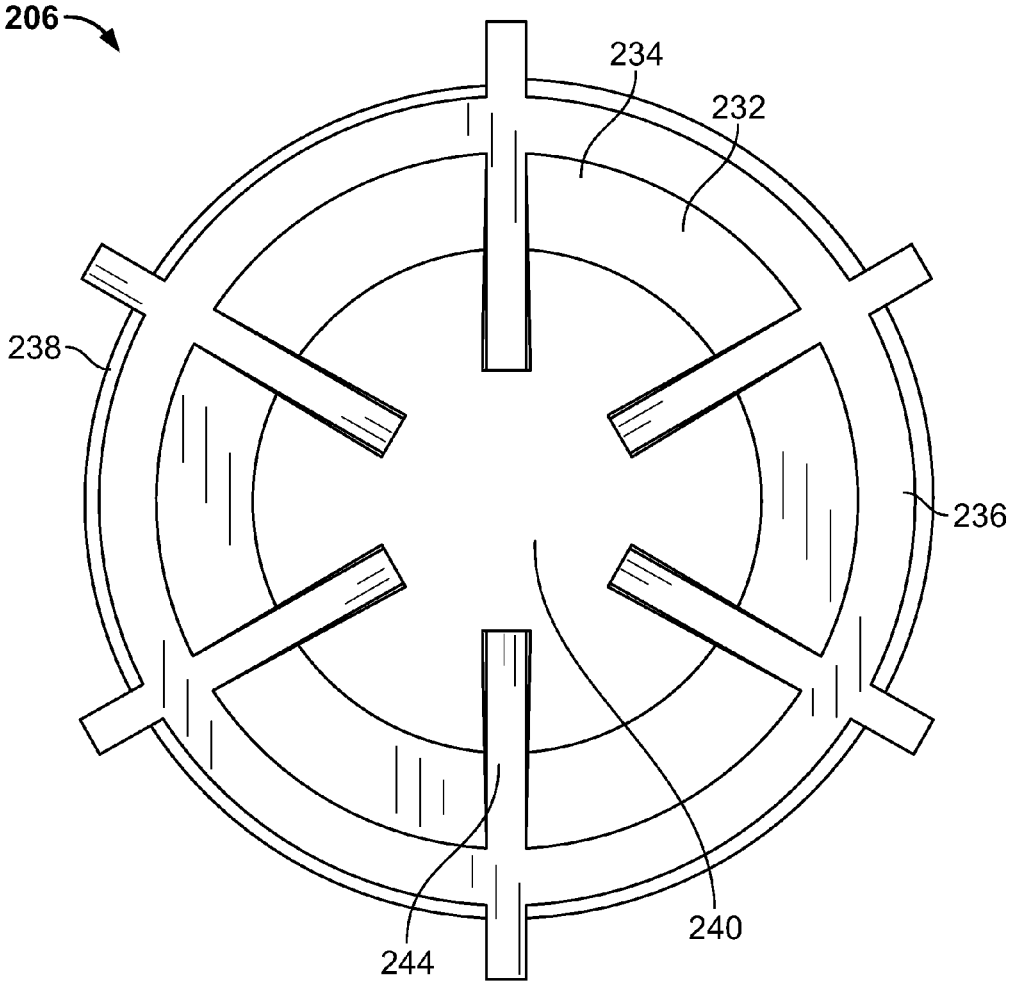
FIG. 24 is a bottom plan view of the lower helical valve portion of the sprinkler head of FIG. 18.

The lower helical valve portion 206 is shown in FIGS. 22-24. It also has a disk-like shape and includes a top surface 234, a bottom surface 236, an outer wall 238, and a central bore 240 for insertion of the shaft 34 therethrough. The top surface 234 defines the second helical engagement surface 232, which has axially offset ends that are joined by a vertical wall 242. The top surface 234 is preferably in the shape of an annular helical ramp. The bottom surface 236 is generally annular and is not helical. The lower helical valve portion 206 also includes spokes 244, preferably six, extending radially through the helical outer wall 238. The spokes 244 are spaced from the central bore 240 to allow insertion of the shaft 34 therethrough and are sized to fit within the recess 210 of the nozzle cover 208.

During a manual adjustment, the user pushes down on the cap 12 so that the deflector teeth 37 engage the corresponding teeth 218 of the upper helical valve portion 204. The upper helical valve portion 204 is rotatable while the lower helical valve portion 206 does not rotate. As the user rotates the cap 12, the sequential arc valve 202 is opened and closed through rotation and camming of the first helical engagement surface 228 with respect to the second helical engagement surface 232. The user rotates the cap 12 to uncover a desired number of apertures 220 corresponding to the desired arc. The vertical walls 230 and 242 of the respective portions engage one another when the valve 202 is fully closed. During this adjustment, the shaft 34 preferably translates a vertical distance corresponding to one helical pitch.

In one preferred form, as can be seen in FIGS. 26 and 27, the upper helical valve portion 204 includes 36 circumferentially-arranged and equidistantly-spaced apertures 220 such that each aperture 220 corresponds to 10° of arc. Thus, for example, the user may rotate the cap 12 to uncover nine apertures 220, which corresponds to 90° (or one-quarter circle) of arc. The sprinkler head 10 preferably includes a feedback mechanism for indicating to the user each 10° of rotation of the cap 12, such as the one described further below.

Fluid flow through the sprinkler head 200 follows a flow path similar to that for the first embodiment: through the inlet 134, between the nozzle collar 128 and the flow control member 130, through the flow passages 168 of the nozzle cover 208, through the open portion of the sequential arc valve 202, upwardly to the underside surface of the deflector 22, and radially outwardly from the deflector 22. Fluid flows through the sequential arc valve 202, however, in a manner different than the valve of the first embodiment. More specifically, fluid flows upwardly through the lower helical valve portion 206 following both an inner and an outer flow path. Fluid flows along an inner flow path between the shaft 34 and second helical engagement surface 232, and fluid flows along an outer flow path between the second helical engagement surface 232 and the nozzle cover 208. Fluid then flows upwardly through the uncovered apertures 220, i.e., the apertures 220 lying between the respective vertical walls 230 and 242. One advantage of this inner and outer flow path through the lower helical valve portion 206 is that the flow stays in a substantially upward flow path, resulting in reduced pressure drop (and relatively high velocity) through the valve 202.

Alternatively, the lower helical valve portion 206 may be modified such that there is only an inner flow path or an outer flow path. More specifically, the second helical engagement surface 232 can be located on the very outside circumference of the lower helical valve portion 206 to define a single inner flow path, or it can be located on an inner circumference adjacent the shaft 34 to define a single outer flow path. Additionally, it will be understood that the lower helical valve portion 206 may be further modified to eliminate the spokes 244.

The sequential arc valve 202 provides certain additional advantages. Like the first embodiment, it uses a spring 186 that is biased to exert a downward force against shaft 34. In turn, shaft 34 exerts a downward force to urge the upper helical valve portion 204 against the lower helical valve portion 206. This downward spring force provides a tight seal of the closed portion of the sequential arc valve 202.

The sequential arc valve 202 also has a concentric design. The structure of the upper and lower helical valve portions 204 and 206 can better resist horizontal, or side load, forces that might otherwise cause misalignment of the valve 202. The different structure of the sequential arc valve 202 is less susceptible to misalignment because there is no need to maintain a uniform radial gap between two valve members. This concentric design makes it more durable and capable of longer life.

Figure 30:
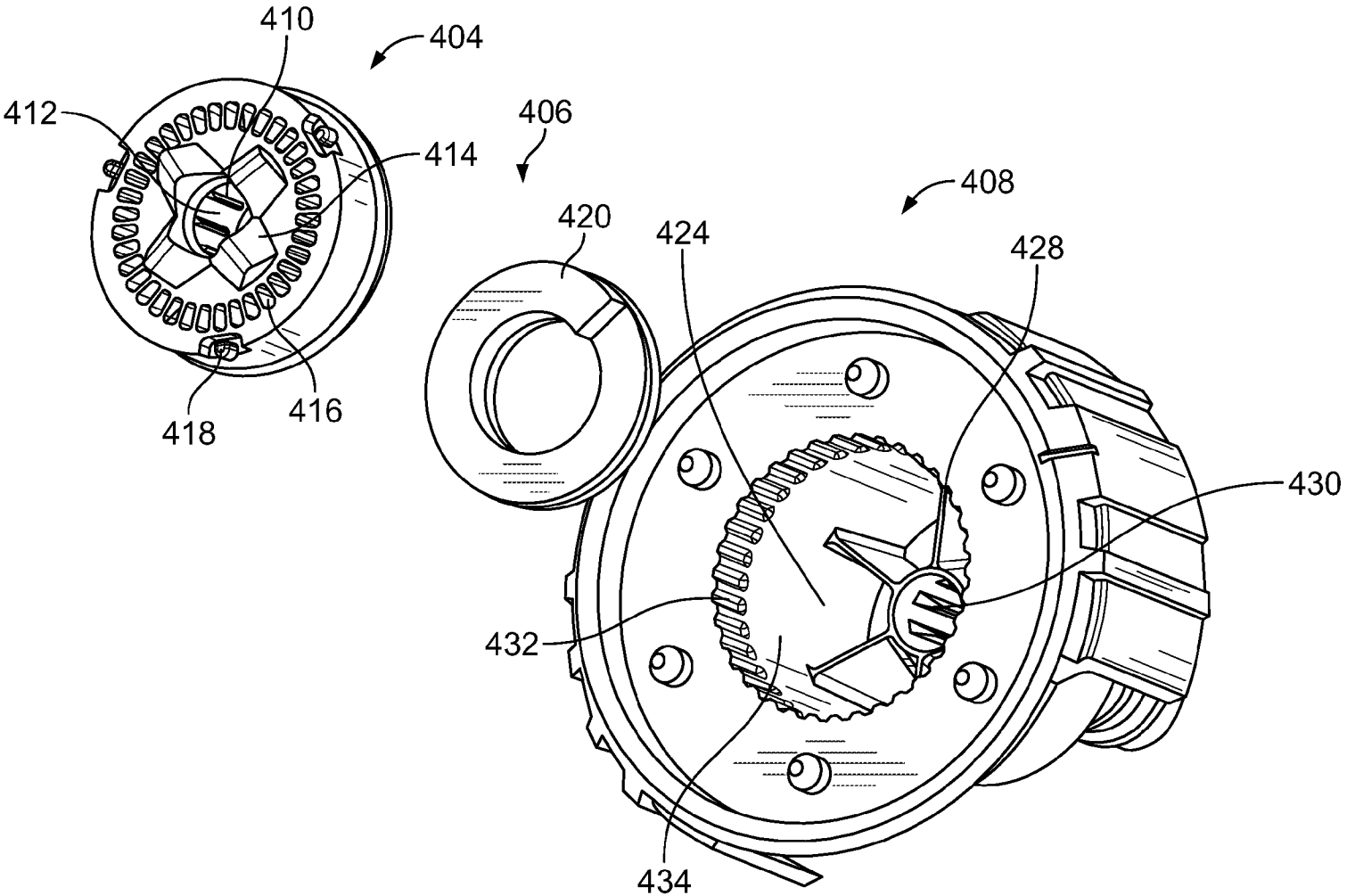
FIG. 30 is a top perspective view of an alternative upper helical valve portion, alternative lower helical valve portion, and alternative nozzle cover for use with the sprinkler head of FIG. 18.
Figure 31:
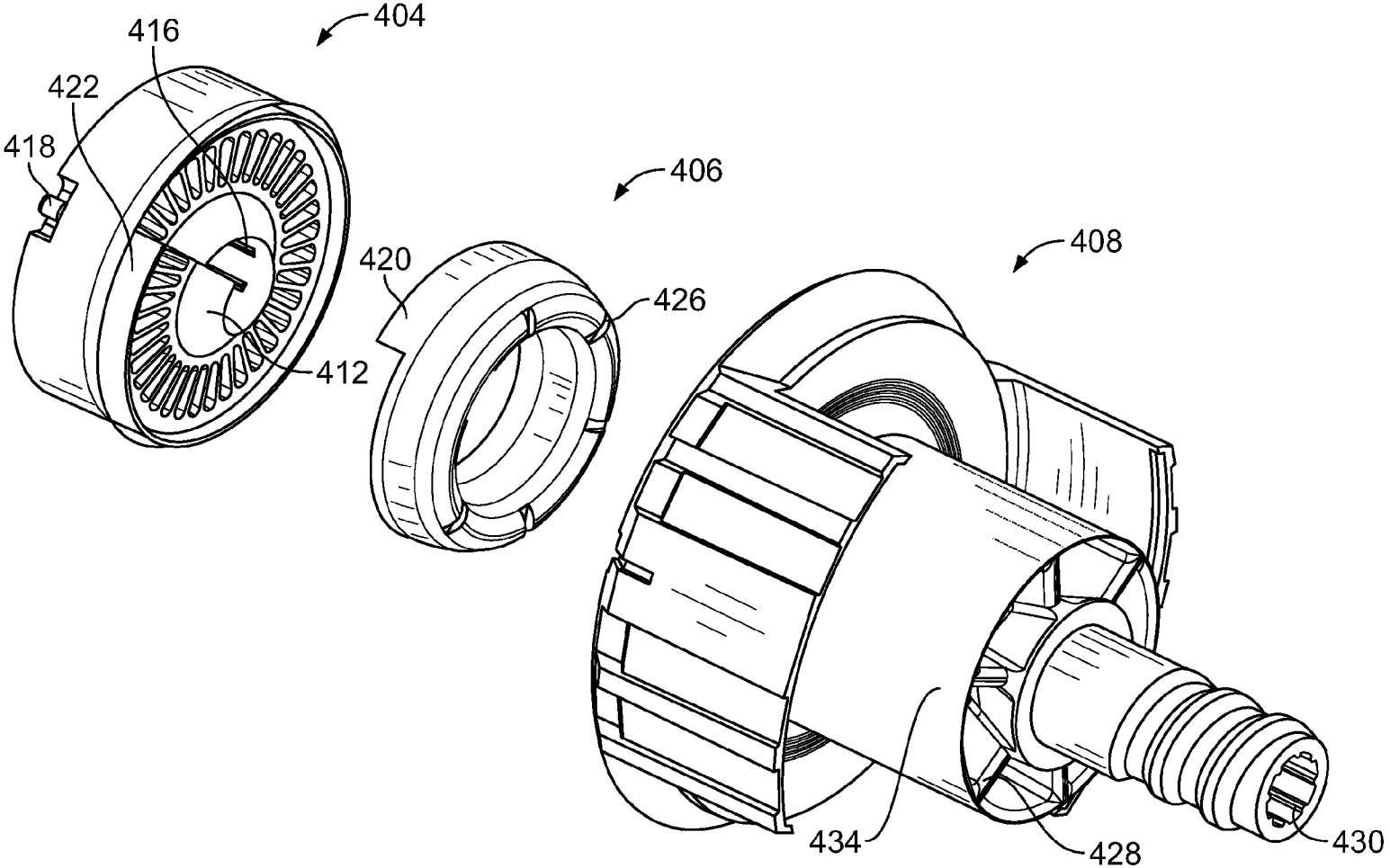
FIG. 31 is a bottom perspective view of the alternative upper helical valve portion, alternative lower helical valve portion, and alternative nozzle cover of FIG. 30.
Figure 32:
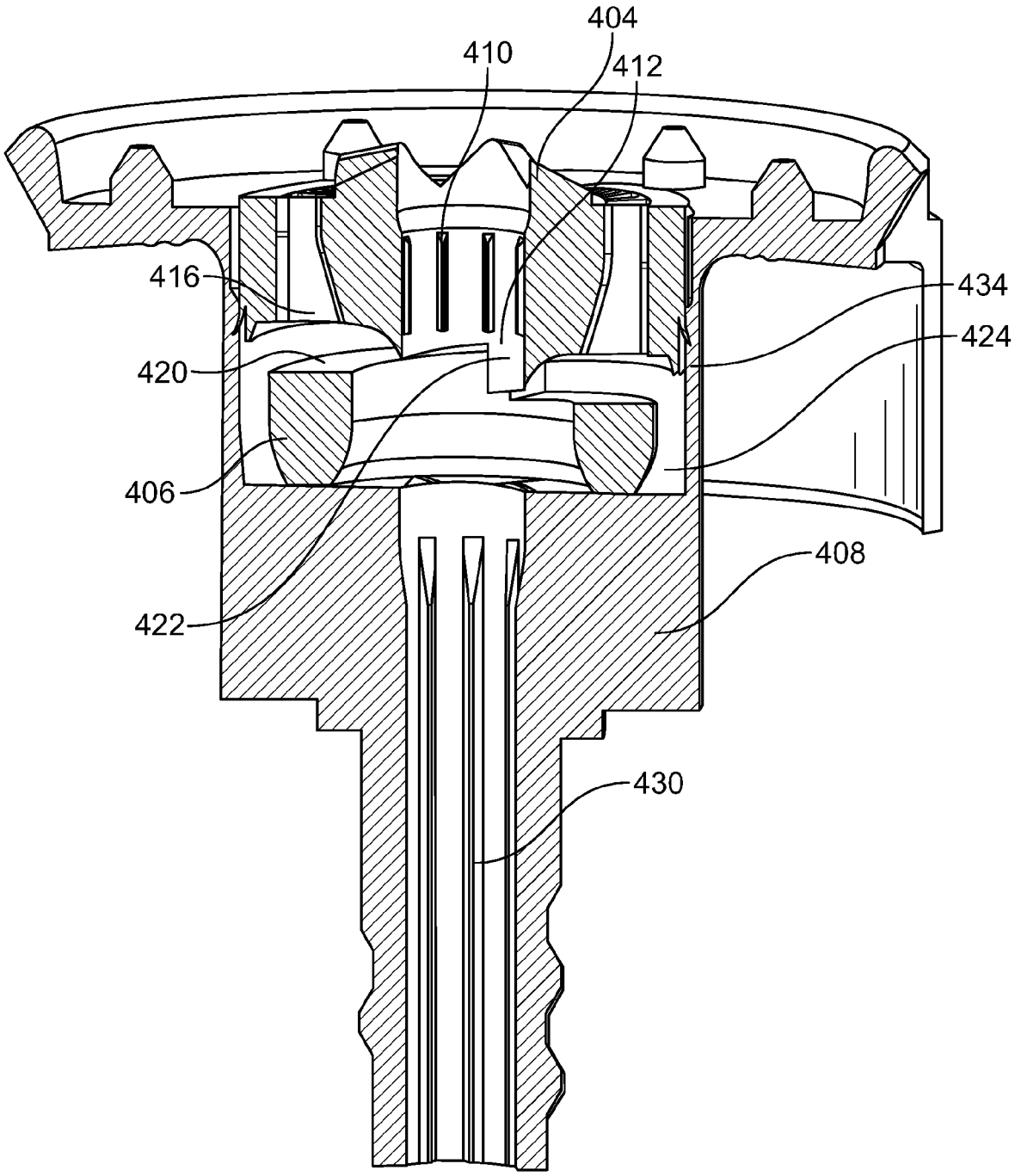
FIG. 32 is a cross-sectional view of the alternative upper helical valve portion and alternative bottom helical valve portion of FIG. 30 mounted in the alternative nozzle cover of FIG. 30.

Alternative preferred forms of upper helical valve portion 404, lower helical valve portion 406, and nozzle cover 408 for use with sprinkler head 200 are shown in FIGS. 30-32. As can be seen, upper helical valve portion 404 includes circumferentially-arranged and equidistantly-spaced crush ribs 410 that extend axially along the inside of the central hub 412. These crush ribs 410 engage the shaft 34 to help keep the upper helical valve portion 404 centered with respect to the shaft 34, i.e., to improve concentricity. As can be seen in FIGS. 30-32, although generally similar in structure, upper helical valve portion 404 includes a few other structural differences from the first preferred version, such as fewer teeth 414, no groove for an o-ring, and a downwardly-projecting helical hub 412.

Upper helical valve portion 404 also includes a feedback mechanism to signal to a user the arcuate setting. Alternative preferred upper helical valve portion 404 includes 36 circumferentially-arranged and equidistantly-spaced apertures 416 such that each aperture 416 corresponds to 10° of arc, and as described above, the user rotates the cap 12 and deflector 22 to increase or decrease the number of apertures 416 through which fluid flows. The upper helical valve portion 404 also preferably includes three detents 418 that are equidistantly spaced on the outer top circumference of the upper helical valve portion 404. These detents 418 cooperate with the nozzle cover 408, as described further below, to indicate to the user each 10° of rotation of the cap 12 and deflector 22 during an arcuate adjustment.

Lower helical valve portion 406 is essentially ring-shaped with a helical top surface 420 for engagement with a helical bottom surface 422 of the upper helical valve portion 404. As shown in FIG. 32, the upper helical valve portion 404 and lower helical valve portion 406 are inserted in a cylindrical recess 424 in the top of nozzle cover 408. The structure of lower helical valve portion 406 has also been modified from the first preferred version 206. Lower helical valve portion 406 preferably does not include radial spokes. Lower helical valve portion 406, however, preferably includes notches 426 in the bottom that engages spokes 428 of the nozzle cover 408 for support and to prevent rotation of lower helical valve portion 406. As can be seen from FIG. 32, fluid flows upwardly through the nozzle cover 408, either through a first outer flow sub-path between the cylinder 434 and the lower helical valve portion 406 or through a second inner flow sub-path between the lower helical valve portion 406 and the shaft (not shown), and then upwardly through the uncovered apertures 416.

Nozzle cover 408 also includes some structural differences from the first preferred version 208. Nozzle cover 408 preferably includes circumferentially-arranged and equidistantly-spaced axial crush ribs 430 for engagement with shaft 34 to improve concentricity. Nozzle cover 408 also preferably includes a ratchet for detents 418, i.e., circumferentially-arranged and equidistantly-spaced grooves 432 formed on the inside of cylinder 434 and positioned to engage detents 418 when the upper helical valve portion 404 is inserted in the cylinder 434. The grooves 432 are preferably spaced at 10° intervals corresponding to the spacing of the apertures 416, although the apertures 416 and grooves 432 may be incrementally spaced at other arcuate intervals.

These grooves 432 cooperate with detents 418 to signal to the user how many apertures 416 the user is covering or uncovering. As the user rotates the cap 12 and deflector 22 during an adjustment, the detents 418 engage the grooves 432 at 10° intervals. Thus, for example, as the user rotates clockwise 90°, the detents 418 will engage the grooves 432 nine times, and the user will feel the engagement and hear a click each time the detents 418 engage different grooves 432. In this manner, the detents 418 and grooves 432 provide feedback to the user as to the arcuate setting of the valve. Optionally, the sprinkler head 200 may include a stop mechanism to prevent over-rotation of the detents 418 beyond 360°.

Figure 20:
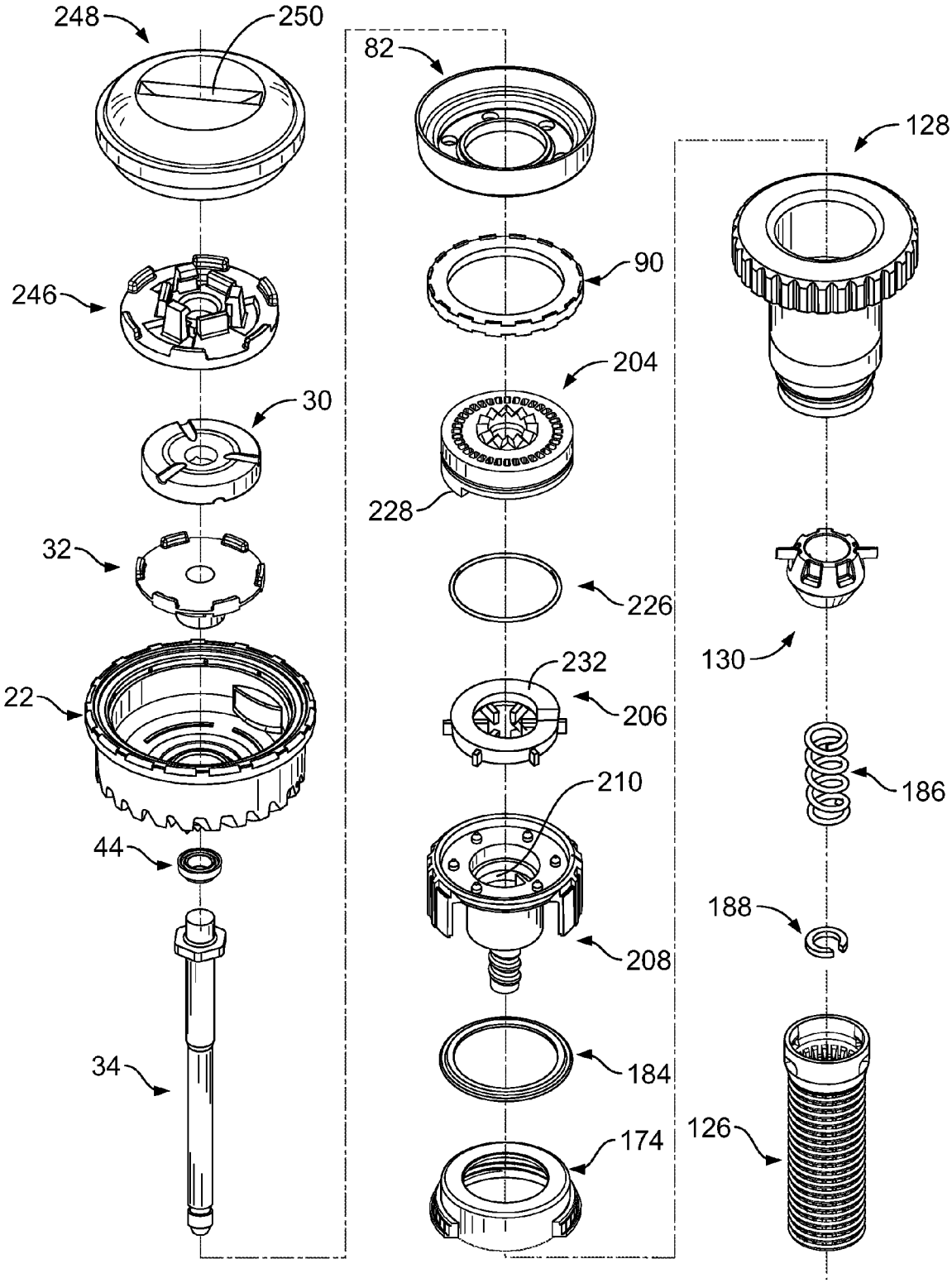
FIG. 20 is a top exploded perspective view of the sprinkler head of FIG. 18.
Figure 21:
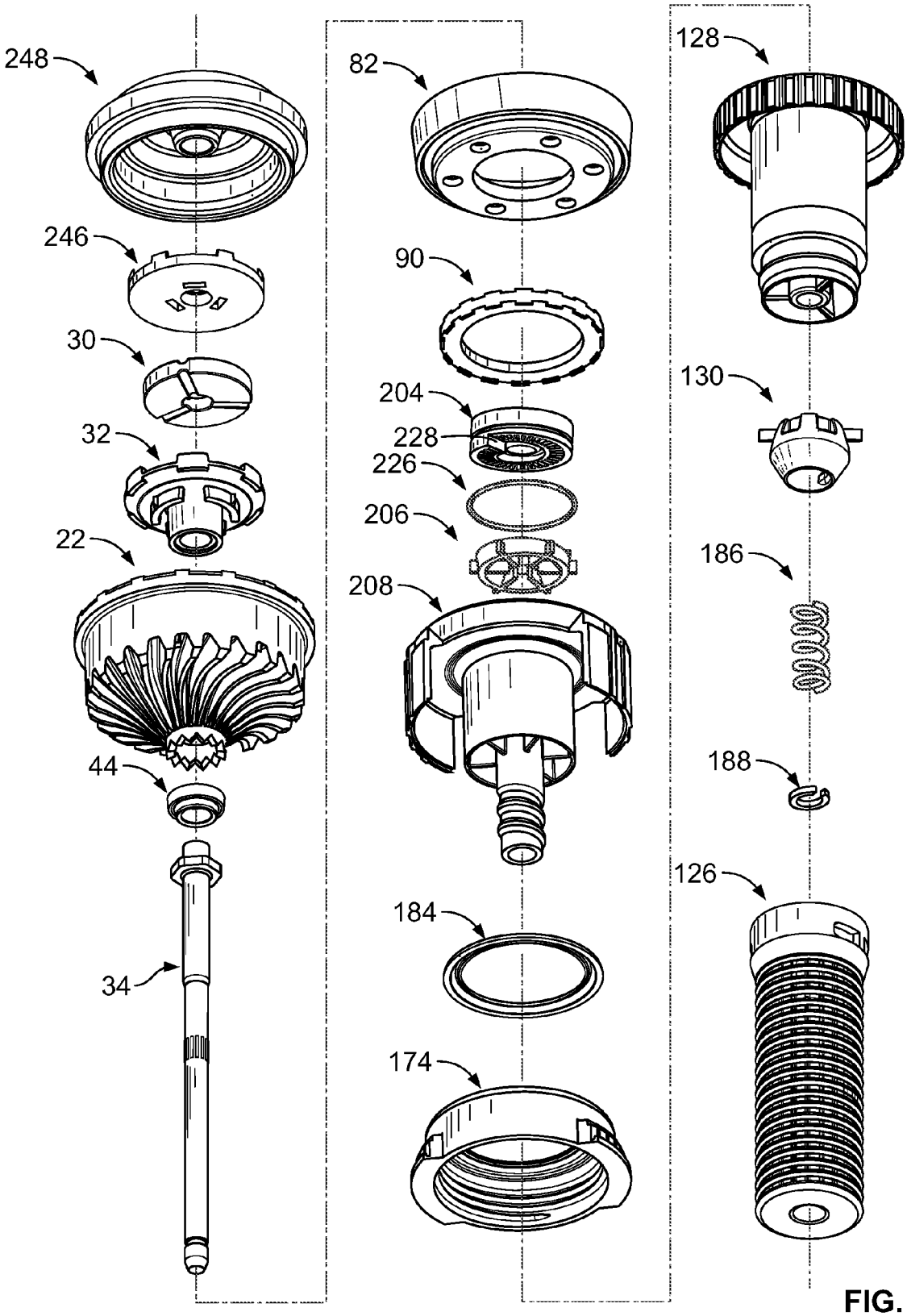
FIG. 21 is a bottom exploded perspective view of the sprinkler head of FIG. 18.

As can be seen in FIG. 20, the sprinkler head 200 may include two other optional modifications. First, the cap 248 may be modified to include a slot 250 in the top surface. As discussed above, the user may directly depress the cap 248 to make an arc adjustment and a hand tool is not necessary to effect the adjustment. Slot 250, however, may be included to signal to the user that an arc adjustment is performed by applying downward pressure to the top part of the cap 248. Second, the brake disk 246 shown in FIG. 20 does not include elastic members that bias the cap 248 and deflector 22 upwardly following an arc adjustment. As should be evident, each of the preferred forms of sprinkler head 10 and sprinkler head 200 may incorporate features from the other.

It should also be evident that the sprinkler heads 10 and 200 may be modified in various other ways. For instance, the spring 186 may be situated at other locations within the nozzle body. One advantage of the preferred forms is that the spring location increases ease of assembly, but it may be inserted at other locations within the sprinkler heads 10 and 200. For example, the spring 186 may be mounted between the lower helical valve portion 206 and the nozzle cover 208 of the second embodiment, which would result in no upward or downward translation of the shaft 34. As an example of another modification, the shaft 34 may be fixed against any rotation, such as through the use of splined engagement surfaces.

Another preferred embodiment is a method of irrigation using a sprinkler head like sprinkler heads 10 and 200. The method uses a sprinkler head having a rotatable deflector and a valve with the deflector moveable between an operational position and an adjustment position and with the valve operatively coupled to the deflector and adjustable in arcuate length for the distribution of fluid from the deflector in a predetermined arcuate span. The method generally involves moving the deflector to the adjustment position to engage the valve; rotating the deflector to effect rotation of the valve to open a portion of the valve; disengaging the deflector from the valve; moving the deflector to the operational position; and causing fluid to flow through the open portion of the valve and to impact and cause rotation of the deflector for irrigation through the arcuate span corresponding to the open portion of the valve. The sprinkler head of the method may also have a spring operatively coupled to the deflector and to the valve and with the valve including a first valve body and a second valve body. The method may also include moving the deflector to the operational position; moving the deflector against the bias of the spring and in a direction opposite the adjustment position; spacing the first valve body away from the second valve body; and causing fluid to flow between the first valve body and the second valve body to flush debris from the sprinkler head.

The foregoing relates to preferred exemplary embodiments of the invention. It is understood that other embodiments and methods are possible, which lie within the spirit and scope of the invention as set forth in the following claims.

What is claimed is:

1. An irrigation sprinkler head comprising:

a rotatable deflector moveable between an operational position and an adjustment position;

a first valve adjustable to change the length of an arcuate opening for the distribution of fluid in a predetermined arcuate span; and a flow path from an inlet through the first valve to the deflector and outwardly away from the deflector within the predetermined arcuate span;

wherein the deflector engages the first valve for setting the length of the arcuate opening in the adjustment position and wherein the deflector disengages from the first valve for irrigation in the operational position.

2. The irrigation sprinkler head of claim 1 wherein the first valve comprises two helical surfaces that engage one another and are moveable with respect to one another for setting the length of the arcuate opening of the first valve.

3. The irrigation sprinkler head of claim 2 wherein the first valve comprises a first valve body defining the first helical surface and a second valve body defining the second helical surface.

4. The irrigation sprinkler head of claim 3 wherein the first valve body is rotatable and is adapted for engagement and rotation by the deflector in the adjustment position for setting the length of the arcuate opening of the first valve.

5. The irrigation sprinkler head of claim 4 wherein the deflector includes a first set of teeth and the first valve body includes a second set of teeth, the two sets of teeth engaging one another for setting the length of the arcuate opening of the first valve.

6. The irrigation sprinkler head of claim 5 wherein the first and second sets of teeth are adapted such that rotation of the first valve body beyond a predetermined position causes the first set to disengage from the second set.

7. The irrigation sprinkler head of claim 4 wherein the first valve body comprises a first wall extending radially and axially along at least part of the first valve body and the second valve body comprises a second wall extending radially and axially along at least part of the second valve body, the first and second walls defining the two boundary edges of fluid flowing through the first valve.

8. The irrigation sprinkler head of claim 4 wherein the first helical surface is inclined radially and the second valve body comprises a cylindrical wall, the first valve body and second valve body configured to define a portion of the flow path wherein fluid impacts the first helical surface, is redirected to impact the cylindrical wall, and is redirected axially to impact the deflector.

9. The irrigation sprinkler head of claim 4 wherein the first helical surface is a downwardly-facing helical ramp and the second helical surface is an upwardly facing helical ramp.

10. The irrigation sprinkler head of claim 4 wherein the first valve body comprises a plurality of circumferentially-arranged apertures extending through the first valve body.

11. The irrigation sprinkler head of claim 10 wherein the first valve body comprises an upstream portion and a downstream portion with the apertures extending therebetween, the total cross-sectional area of the apertures being greater on the upstream portion than on the downstream portion.

12. The irrigation sprinkler head of claim 10 wherein the second valve body defines two separate flow sub-paths, a first flow sub-path that is located radially inside of the second valve body and a second flow sub-path that is located radially outside of the second valve body.

13. The irrigation sprinkler head of claim 12 wherein the second valve body further comprises a plurality of spokes extending in a radial direction, the spokes defining a plurality of flow passages for the first flow sub-path and the second flow sub-path.

14. The irrigation sprinkler head of claim 12 wherein the flow path is defined by fluid flowing substantially axially along either the first flow sub-path or the second flow sub-path and then substantially axially through the apertures.

15. The irrigation sprinkler head of claim 4 wherein the first valve body further comprises at least one member for indicating the arcuate length of the first valve.

16. The irrigation sprinkler head of claim 15 further comprising a plurality of grooves formed on a non-rotating portion of the sprinkler head, the at least one rotatable member engaging at least one groove corresponding to one length of the arcuate opening and rotatable to engage at least one different groove corresponding to a different length of the arcuate opening.

17. The irrigation sprinkler head of claim 3 further comprising a shaft defining a central axis and supporting the rotatable deflector near a first end of the shaft.

18. The irrigation sprinkler of claim 17 wherein the shaft is fixed against rotation.

19. The irrigation sprinkler head of claim 18 wherein the shaft is fixed against axial movement.

20. The irrigation sprinkler head of claim 17 wherein the first valve body and the second valve body further comprise circumferentially arranged and axially extending ribs for engagement with the shaft.

21. The irrigation sprinkler head of claim 17 further comprising a spring mounted to the shaft and biased to urge at least a portion of the first valve body and at least a portion of the second valve body axially into engagement with one another.

22. The irrigation sprinkler head of claim 21 wherein the spring is mounted near a second end of the shaft, the spring biased to urge the first valve body axially against the second valve body and opposite the direction of fluid flowing along the flow path to tighten the engagement between the at least a portion of the first valve body and the at least a portion of the second valve body.

23. The irrigation sprinkler head of claim 22 wherein the second end of the shaft is upstream of the sprinkler head inlet and the spring is mounted and biased to urge the shaft away from the deflector.

24. The irrigation sprinkler head of claim 21 wherein the rotatable deflector is operatively coupled to the spring and is moveable against the bias of the spring to a flushing position for flushing debris from the first valve.

25. The irrigation sprinkler head of claim 17 further comprising at least one elastic member operatively coupled to the shaft and adapted to bias the deflector away from the first valve when the deflector is in the adjustment position.

26. The irrigation sprinkler head of claim 1 wherein the deflector includes an underside surface defining an array of spiral vanes adapted for distributing fluid outwardly in a plurality of radial fluid streams.

27. The irrigation sprinkler head of claim 1 further comprising a second valve for adjustment of the flow rate through the sprinkler head.

28. The irrigation sprinkler head of claim 27 wherein the second valve comprises a first valve member operatively coupled to a second valve member, the first and second valve members configured so that rotation of the first valve member causes axial movement of the second valve member either toward or away from the inlet.

29. The irrigation sprinkler head of claim 28 wherein the second valve member is an internally threaded nut mounted for axial movement along external threading.

30. The irrigation sprinkler head of clam 29 wherein the first valve member comprises one or more rotatable outer wall portions of the sprinkler head for causing axial movement of the second valve member.

31. The irrigation sprinkler head of claim 30 wherein the first valve member further comprises a substantially cylindrical rotatable portion having a splined internal surface for engagement with the second valve member, rotation of the first valve member causing rotation of the second valve member.

32. The irrigation sprinkler head of claim 31 wherein the second valve member comprises at least one tab extending radially outward for engagement with the splined surface of the first valve member.

33. The irrigation sprinkler head of claim 32 wherein the at least one tab and the splined surface are configured such that rotation of the first valve member beyond a predetermined position causes the at least one tab to disengage from the splined surface.

34. The irrigation sprinkler head of claim 1 further comprising a brake for reducing the rotational speed of the deflector.

35. A method of irrigation using an irrigation sprinkler head having a rotatable deflector and a valve, the deflector moveable between an operational position and an adjustment position, the valve adjustable to set a length of an arcuate opening for the distribution of fluid from the deflector in a predetermined arcuate span, the sprinkler head having a flow path from an inlet through the valve to the deflector and outwardly away from the deflector within the predetermined arcuate span, the method comprising:

moving the deflector to the adjustment position to engage the valve;

rotating the deflector to effect rotation of the valve to open or close a portion of the valve to set the length of the arcuate opening;

disengaging the deflector from the valve for irrigation in the operational position; and causing fluid to flow through the open portion of the valve and to impact and cause rotation of the deflector for irrigation through the arcuate span corresponding to the open portion of the valve.

36. The method of claim 35 wherein the irrigation sprinkler head further comprises a spring operatively coupled to the deflector and to the valve, the valve including a first valve body and a second valve body, the method further comprising:

moving the deflector to the operational position;

moving the deflector against the bias of the spring and in a direction opposite the adjustment position;

spacing the first valve body away from the second valve body; and causing fluid to flow between the first valve body and the second valve body to flush debris from the sprinkler head.

* * * * *